United States Patent [19]
Humphries
[11] 4,201,982
[45] May 6, 1980

[54] FOUR WIRE MULTI-SATELLITE INTRUSION ALARM WITH MULTIPLEX ANNUNCIATION

[75] Inventor: Peter E. Humphries, King, Canada

[73] Assignee: Contronic Controls Limited, Mississauga, Canada

[21] Appl. No.: 898,238

[22] Filed: Apr. 20, 1978

Related U.S. Application Data

[63] Continuation-in-part of Ser. No. 770,867, Feb. 22, 1977, Pat. No. 4,138,674.

[51] Int. Cl.[2] ..... G08B 29/00
[52] U.S. Cl. ..... 340/506; 340/152 T; 340/514; 340/552; 343/5 PD
[58] Field of Search ..... 340/506, 502, 503, 504, 340/505, 514, 518, 551, 552, 554, 565, 152 T; 343/5 PD

[56] References Cited

U.S. PATENT DOCUMENTS

| | | | |
|---|---|---|---|
| 3,932,870 | 1/1976 | Shapiro et al. | 340/554 |
| 3,938,118 | 2/1976 | Galvin et al. | 340/554 |
| 4,101,875 | 7/1978 | Humphries | 340/552 |

*Primary Examiner*—John W. Caldwell, Sr.
*Assistant Examiner*—Donnie L. Crosland
*Attorney, Agent, or Firm*—Rogers, Bereskin & Parr

[57] ABSTRACT

An intrusion alarm system has a number of satellites each connected to a master by an unshielded cable having only four conductors, namely two power conductors, a drive signal conductor which supplies drive to the satellite transmitter and the satellite control circuit, and an alarm conductor. When an intrusion is detected by a satellite, its control circuit transmits a high level alarm signal on the alarm conductor to the master and also sets a latch in the satellite. The master has a rocker switch which an investigator turns off when he arrives at the supervised premises. This turns off the drive signal to the satellite and causes a counter in the master to send a set of interrupting counting pulses to the satellites on the drive conductor. Each satellite has a counter which counts the pulses if that satellite's latch has been set and sends a pulse back to the master on the alarm conductor immediately after the count associated with that counter. The received pulses are recorded in a register in the master and then displayed to show the status of the satellites. A tamper switch in each satellite operates if the satellite has been tampered with and also sets the latch, so that with the satellite transmitter off, the status of the tamper switches can be annunciated. A test transceiver having its own transmitter and receiver is provided to test each satellite.

11 Claims, 27 Drawing Figures

+6V
80
128
120
INVERTER
124
C3
R4
R3
NAND
122
NOR
118
116
148
NAND
114
112
142
NAND
108
107
140
LATCH
106
104
138
S
R
LATCH
110
109
134
INVERTER
102
TRIGGER
100
C1
R2
+6V
D1
TO TRANSMITTER
TRIGGER
50
R1
40a
TRIGGER
132
130
C4
R5
D2
+6V
150
154
NAND
152
NAND
R7
R8
C5
R102
40b
66
C2
R100
R101
R6
304
Q3
Q4
Q2
TRIGGER
62
D3
C6
FROM SIGNAL PROCESSOR 60
300
302
308
304
306

FOUR WIRE MULTI-SATELLITE INTRUSION ALARM WITH MULTIPLEX ANNUNCIATION

This application is a continuation-in-part of my co-pending U.S. patent application Ser. No. filed Feb. 22, 1977 now U.S. Pat. No. 4,138,674 770,867.

This invention relates to a four wire satellite control system for a multi-satellite intrusion alarm, the system providing multiplexed enunciation so that the status of the satellites can be readily determined.

My co-pending applications Ser. Nos. 742,047, now U.S. Pat. No. 4,101,875 and 770,867 describe a multi-satellite intrusion alarm in which a number of separate satellites are connected to a master control unit by four-wire connecting cables. The satellites each operate by transmitting a wave field (typically ultrasonic or electromagnetic radiation) into an area under supervision, receiving a portion of the reflected field, and comparing the two. If a moving intruder is present, a doppler shift is detected in the received field. The doppler frequency is processed and is used to produce an alarm signal at the satellite in question. The alarm signal is conducted from the satellite to the master control unit which in turn generates an appropriate alarm for transmission to an alarm company or to police headquarters or the like.

In the system described in my said-copending applications, specific procedures must be employed to determine which of the various satellites connected to the master control unit has generated an alarm. Specifically, an investigator must visit the premises, operate a switch to place the system in its "alarm investigate" or annunciate mode, and then walk through the areas being supervised to see which satellite is then generating a visible or audible alarm signal. This is described in section D of both my said co-pending applications.

In some cases, for example if the building being supervised is extremely large, it would be desirable for the investigator to be able to determine, when he reaches the building in question and operates the master control unit to place the system in its enunciate mode, which satellites produced an alarm signal without walking through all of the rooms of the building. At the same time, it is also desirable that the satellites be connected to the master control unit as simply as possible, with ordinary four conductor unshielded cable, to reduce the cost of installation.

Accordingly, the present invention provides an intrusion alarm control system in which each satellite is connected to the master control unit by only four wires, which normally need not be shielded, and in which remote annunciation is provided, so that upon operation of an appropriate control at a control location, each satellite will report its status (alarm or no alarm) sequentially to that location and the status of each satellite will then be displayed, so that the investigator need not investigate each satellite individually.

Further objects and advantages of the invention will appear from the following disclosure, taken together with the accompanying drawings, in which:

FIG. 19 shows waveforms for the FIGS. 17 and 18 schematics;

GENERAL DESCRIPTION

Figure 1:
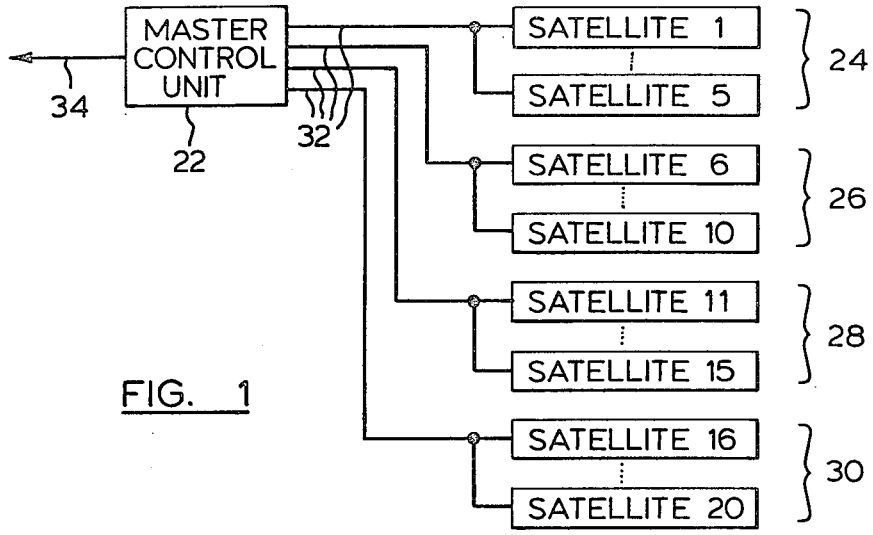
FIG. 1 is a block diagram showing a conventional connection arrangement of satellites to a master control unit.

Reference is first made to FIG. 1, which shows a typical connection system for a master control unit and satellites. The connection system of FIG. 1 has been used in most conventional alarm systems and is preferably also used in the alarm system of the invention. As shown, a master control unit 22 is connected to four satellite zones 24, 26, 28, 30. Each satellite zone typically consists of five satellites, which are indicated as satellites 1 to 5, 6 to 10, 11 to 15 and 16 to 20. The satellites of each zone are connected together and to the master control 22 by cables 32.

In operation, if an intruder is detected by any satellite in a zone, for example in satellite 1 of zone 24, a signal (which in conventional systems usually requires further analysis) is sent to the master control unit 22. The master control unit 22 generates an appropriate alarm signal, which may be sent by a telephone line 34 either to the alarm company whose duty it is to supervise the premises in question, or to police headquarters, or as desired.

As indicated previously, the cables 32 connecting the satellites to the master are usually shielded, and usually contain numerous conductors. Because of this, installation of the satellites is usually a difficult and expensive task.

Figure 2:
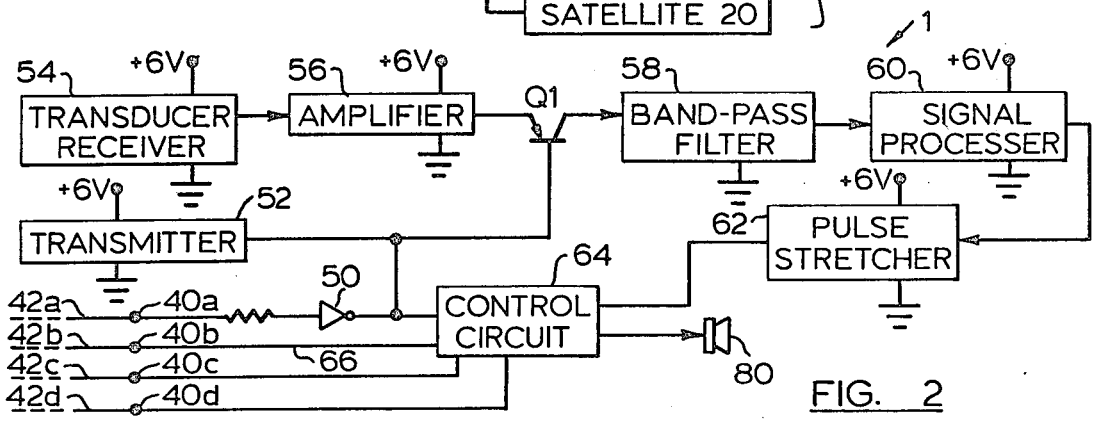
FIG. 2 is a block diagram of a satellite according to the invention.
Figure 3:
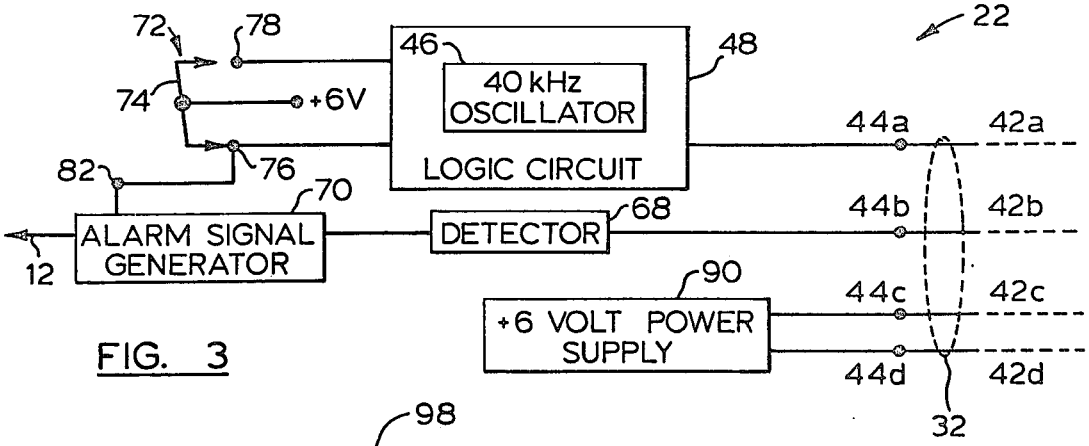
FIG. 3 is a block diagram showing a portion of a master control unit of the invention.

According to the invention, means are provided in the satellites and in the master control unit 22 so that the cable 32 need contain only four conductors. These means are shown in block diagram form in FIGS. 2 and 3. FIG. 2 shows a typical satellite, for example satellite 1 of zone 24. Satellite 1 includes four terminals 40*a*, 40*b*, 40*c*, 40*d* which are connected by conductors 42*a*, 42*b*, 42*c*, 42*d* to four corresponding terminals 44*a*, 44*b*, 44*c*, 44*d* in the master 22 (FIG. 3). As will be explained, conductor 42*a* is a drive conductor, conductor 42*b* is an alarm conductor, and conductors 42*c*, 42*d* are power supply conductors.

In the example here illustrated, it is assumed that the transmitted field is ultrasonic sound at a frequency of 40 KHz. Accordingly, the master 22 includes a 40 KHz transmitter 46, which forms part of a logic circuit 48. The transmitter 46 applies a 40 KHz drive signal to terminal 44*a*, and thence through drive conductor 42*a* to terminal 40*a* of the satellite 1. In satellite 1 the 40 KHz signal is squared by a Schmidt trigger 50, which improves the waveform of the drive signal and ensures that its peak amplitude is constant. The 40 KHz signal is then sent to transmitter 52 (FIG. 2), which radiates at 40 KHz ultrasonic sound field.

A portion of the reflected field is received by a transducer-receiver 54, amplified by amplifier 56, and then directed to a synchronous detector consisting of transistor Q1. The base of transistor Q1 is driven by the 40 KHz drive signal. The signal from the transistor Q1 collector is passed to a band pass filter 58, which removes the 40 KHz component and also removes very low frequencies. The signal from the band pass filter 58 is then directed to a signal processor 60. The signal processor 60 processes the signal from filter 58 and produces an alarm signal if the signal from filter 58 contains the doppler frequencies which are likely to have been generated by a moving intruder (40 Hz to 300 Hz for a 40 KHz transmitted sound field). Various known forms of signal processing circuits may be used for processor 60. A preferred signal processing circuit is shown in my co-pending application Ser. No. 742,048 filed Nov. 15, 1976 and entitled "Filter System and Method for Intrusion Alarm".

The alarm signal (if any) from signal processor 60 may be of extremely short duration, so it is directed into a pulse stretcher 62 (typically a Schmitt trigger) which produces a pulse of fixed length when it is triggered. The pulses (if any) from the pulse stretcher 62 are fed to a control circuit 64, which then sends an appropriate high level signal back to the master 22 via conductor 66, terminal 40*b*, alarm conductor 42*b*, and terminal 44*b*. This signal is received in in the master by a detector 68, which then provides a signal to operate an alarm signal generator 70. The signal from generator 70 may be of any desired form, e.g. it may operate a telephone to alert the alarm company.

As shown in FIG. 3, the logic circuit 48 includes a three position rocker switch 72 having a rocker element 74. The three positions of rocker switch 72 are (i) the position shown in FIG. 3, in which rocker element 74 contacts lower terminal 76, (ii) a position in which rocker element 74 contacts upper terminal 78, (iii) a central position in which rocker element 74 contacts neither of terminals 76, 78. The position shown in FIG. 3 is the normal supervisory position. In this position, rocker switch 72 controls logic circuit 48 so that the 40 KHz signal from oscillator 46 is applied to terminal 44*a*.

If an alarm signal is produced by generator 70, and after an authorized person arrives at the premises to investigate, he will place rocker switch 72 in its central position, in which rocker element 74 does not contact either of terminals 76, 78. As will be explained, the logic circuit 48 then removes the 40 KHz drive signal from terminal 44*a*, so that the satellite 1 (and the other satellites in zone 1) will no longer generate an alarm. This enables the person to investigate the premises protected by zone 1 without creating additional alarms. (He may also switch the corresponding rocker switches for the other zones to their central positions, thus also preventing any of the other satellites from generating an alarm signal. One switch actuator may be used for the rocker switches of all the zones.)

When the authorized person switches off the 40 KHz drive signal at the master 22, the control circuit 64 of FIG. 2 responds to the combination of the terminated 40 KHz drive signal, and the alarm signal which was previously received from pulse stretcher 62, and operates a speaker 80 in the satellite. Thus, when the investigating person walks through the area supervised by the satellite which generated the alarm signal, he will hear the speaker 80 and will know which satellite generated the alarm.

When the investigator moves rocker element 74, power is removed from terminal 82 of alarm signal generator 70. This, by conventional means, places generator 70 in a constant alarm condition, so that the alarm company will know that the system is not in its normal supervisory condition.

After the investigating person has completed his investigation, he can then place the system in a "walk test" condition by moving the rocker switch 72 so that the rocker element 74 contacts terminal 78. This operates the logic circuit 48 of FIG. 3 to resume supply of the 40 KHz drive signal to the satellites, including the satellite 1 of FIG. 2. The control circuit 64 of satellite 1 reacts to the resumption of the 40 KHz drive signal at terminal 40*a* by altering the control of the speaker 80, so that the speaker 80 will now be operated whenever an alarm pulse from pulse stretcher 62 is produced. Therefore, as the investigator walks through the area supervised by satellite 1, he can test and determine the extent of coverage of satellite 1 and whether it is operating properly or generating false alarms. The same applies to the other satellites in zone 1 (and in any other zones where rocker switches have been moved to the "walk test" position).

After the walk test has been completed, the investigator moves the rocker switch 72 back to its orginal position, in which rocker element 74 contacts terminal 76. This causes the logic circuit 48 to send a timed reset signal along drive conductor 42*a*, as will be described, to actuate the control circuit 64 of each satellite to resume its original supervisory mode of operation. Power is also reapplied via terminal 82 to the alarm signal generator 70.

As will also be described, during the time when the satellite is not generating an alarm signal, its control circuit 64 send a supervisory signal over alarm conductor 42*b* to the master 22. If the supervisory signal ceases for example because the cable 32 is cut or short circuited, this operates the detector 68 which causes the alarm signal generator 70 to operate. Similarly, if for some reason the 40 KHz drive signal from the master 22 to the satellite 1 ceases, the control circuit 64 of the satellite reacts by ceasing to apply the supervisory signal to terminal 40*b*, again causing detector 68 to operate.

The remaining two conductors 42*c*, 42*d* of FIGS. 2, 3 supply +6 volts and a common return respectively to the various components shown in FIG. 2. These two conductors are shown as connected directly to a six volt power supply 90 in the master 22, and are indicated as being connected to the components of FIG. 3 by the diagramatic showing of these components as being connected to +6 volts and ground.

Detailed Description

A - Circuit Description

Figure 5:
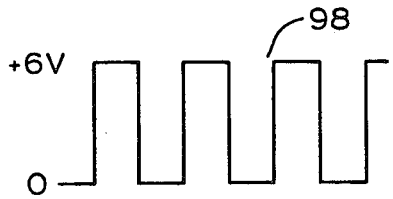
FIG. 5 shows a drive wave form produced at a satellite.
Figure 4:
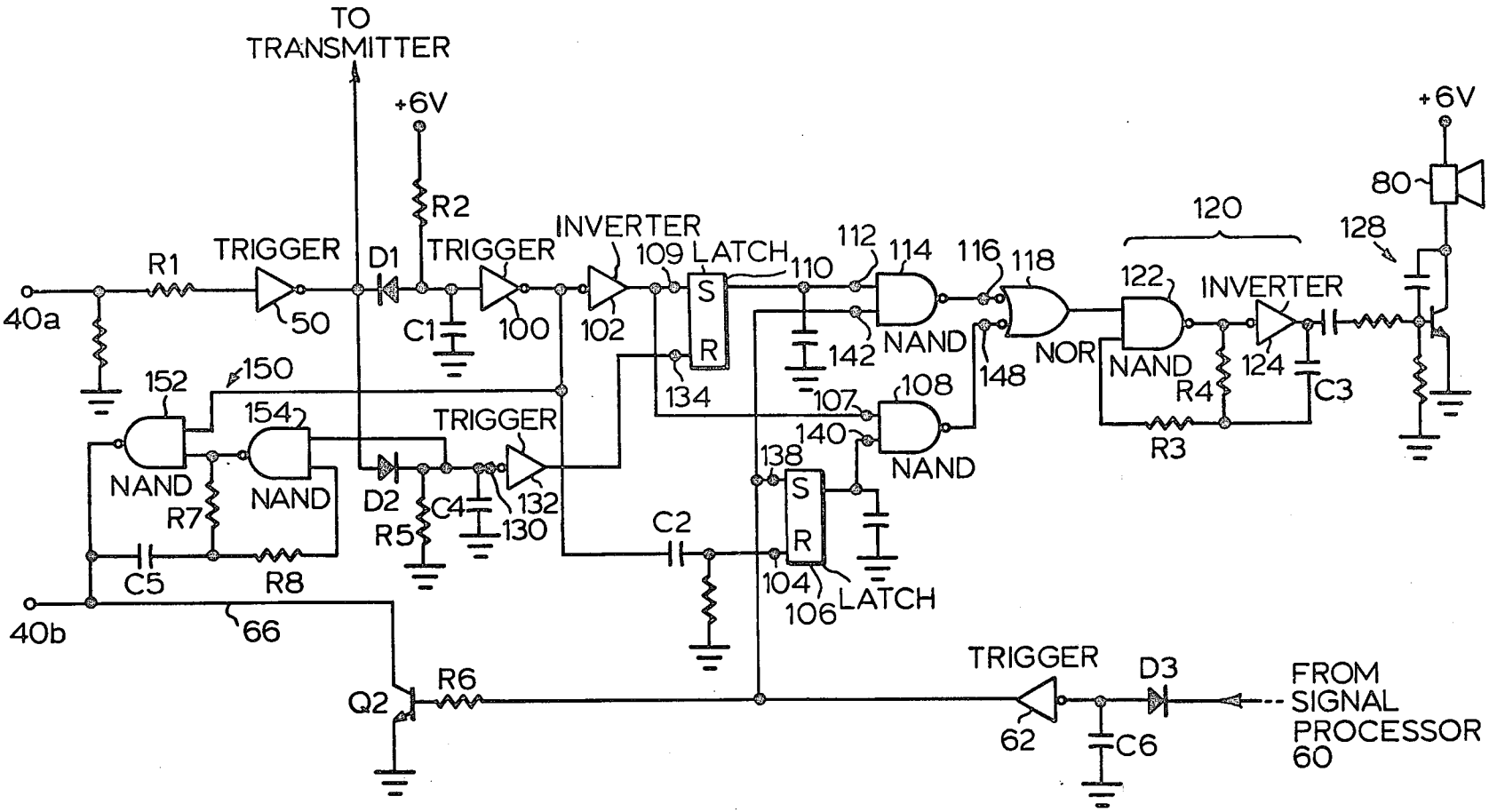
FIG. 4 is a schematic of a control circuit of a satellite.

Reference is next made to FIG. 4, which shows in detail the satellite control circuit 64. As shown in FIG. 4, the 40 KHz drive signal from terminal 40*a* is fed through resistor R1 to the Schmitt trigger 50, which produces a constant peak amplitude square wave train 98 (FIG. 5) from the drive signal. The wave train 98 is fed to the transmitter 52 and the base of transistor Q1, as described, and is also fed through diode D1 to the input of a second Schmidt trigger 100. The positive side of diode D1 is connected through resistor R2 to the +6 volt supply and is also connected through capacitor C1 to ground.

The output of Schmitt trigger 100 is fed to an inverter 102 and also through capacitor C2 to the reset terminal 104 of a memory latch 106. The output of the inventer 102 is fed to one input 107 of a NAND gate 108, and also to the set terminal 109 of a second memory latch 110. The output of latch 110 is directed to one terminal 112 of a NAND gate 114. The output of the NAND gate 114 is fed to one input 116 of NOR gate 118. The output of NOR gate 18 is directed to the input of an oscillator 120 (typically 5 KHz) consisting of NAND gate 112, inverter 124, resistors R3 and R4, and capacitor C3. The output of the oscillator 120 is fed through amplifier 128 to the speaker 80.

The square wave train from the input trigger 50 is also fed through a second diode D2 to the input 130 of another. Schmitt trigger 132. The input 130 of the Schmitt trigger 132 is connected to ground, through the parallel combination of resistor R5 and capacitor C4. The output of Schmitt trigger 132 is connected to the reset terminal 134 of the memory latch 110.

The output of Schmitt trigger 62 (the pulse stretcher) is connected to the set terminal 138 of memory latch 106 and also to an input terminal 142 of NAND gate 114. The output of latch 106 is connected to an input terminal 140 of NAND gate 108. The output of NAND gate 108 is connected to input 148 of NOR gate 118. NOR gate 118 is a negative logic gate and therefore functions like a NAND gate, producing a high at its output when either input goes low, as will become apparent from the description.

The output of Schmitt trigger 62 is also connected through resistor R6 to the base of transistor Q2, the collector-emitter circuit of which is connected between ground and terminal 42*b*.

Finally, the FIG. 4 circuit includes a 10 Hz oscillator 150, consisting of NAND gates 152, 154, timing resistors R7 R8, and timing capacitor C5. Oscillator 150 applies a 10 Hz signal to terminal 40*b* so long as the 40 KHz signal is present at terminal 40*a*, as will be explained.

B - Operation - Supervisory Condition

The detailed operation of the FIG. 4 circuit is as follows. So long as the 40 KHz driving signal is present at terminal 40*a*, Schmitt trigger 50 produces the square wave signal 98 shown in FIG. 5, varying between +6 volts (when the driving signal is low), and ground (when the driving signal is high). Signal 98 maintains capacitor C1 discharged so long as the 40 KHz driving signal is present at terminal 40*a*. This is because diode D1 is reversed by the "on" half cycles of signal 98, permitting capacitor C1 to charge slowly through resistor R2 during "on" half cycles, but during "off" half cycles diode D1 is forward biased, discharging capacitor C1 through diode D1 and through a low resistance connection to ground (not shown) which is made in the Schmitt trigger 50.

The opposite situation prevails with regard to capacitor C4. This capacitor is normally charged, since during "on" on half cycles of signal 98, diode D2 is forward biased, permitting rapid charging of capacitor C4, while during "off" half cycles, diode D2 is reverse biased, causing capacitor C4 to discharge slowly through resistor R5.

Figure 6:
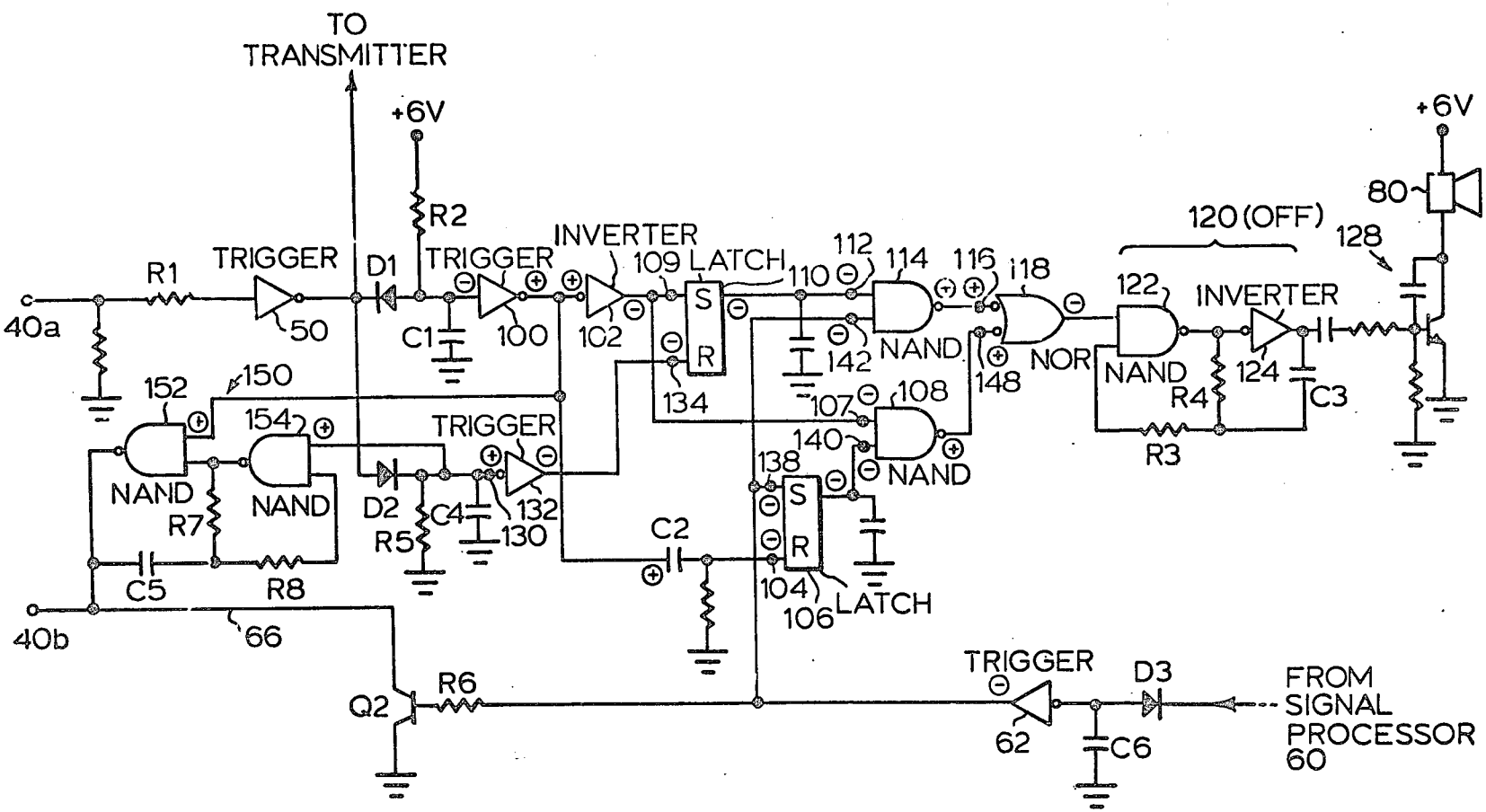
FIG. 6 shows a portion of the control circuit of FIG. 4 in supervisory condition with the condition of certain logic elements indicated thereon.

So long as capacitor C1 remains discharged, the output from Schmitt trigger 100 is high (i.e. +6 volts), since it is an inverting trigger, and the output from inverter 102 is low (i.e. ground), so the memory latch 110 is not set. Latch 110 therefore applies a low to input 112 of NAND gate 114. Inverter 102 also applies a low to input 107 of NAND gate 108. The output of NAND gate 108 is now high, applying a high to the second input 148 of NOR gate 118. So long as both inputs of NOR gate 118 are high, the output of gate 118 is low, inhibiting oscillator 120. The speaker 80 therefore remains silent. This situation is shown in FIG. 6, in which highs are indicated by + signs and lows are indicated by − signs.

In addition, so long as the 40 KHz driving signal is present, a high is applied from Schmitt trigger 100 to NAND gate 152 of 10 Hz oscillator 150, and a second high is applied from the input of trigger 132 to NAND gate 154 of oscillator 150. Oscillator 150 operates in conventional manner to apply a 10 Hz square wave train of about 6 volts amplitude to terminal 40*b*. The 10 Hz wave train is transmitted to the master 22 (FIG. 3) and received by the detector 68. So long as the detector 68 receives the 10 Hz signal, it will not operate the alarm signal generator 70.

C - Supervisory Condition - Alarm

If an intrusion occurs, causing a high pulse (+6 volts) from Schmitt trigger 62, this pulse turns on transistor Q2 for the duration of the pulse. Transistor Q2 grounds terminal 40*b*, stopping transmission of the 10 Hz signal from oscillator 150 to the detector 68. The absence of the 10 Hz signal triggers the detector 68, causing it to operate the alarm signal generator 70.

Figure 7:
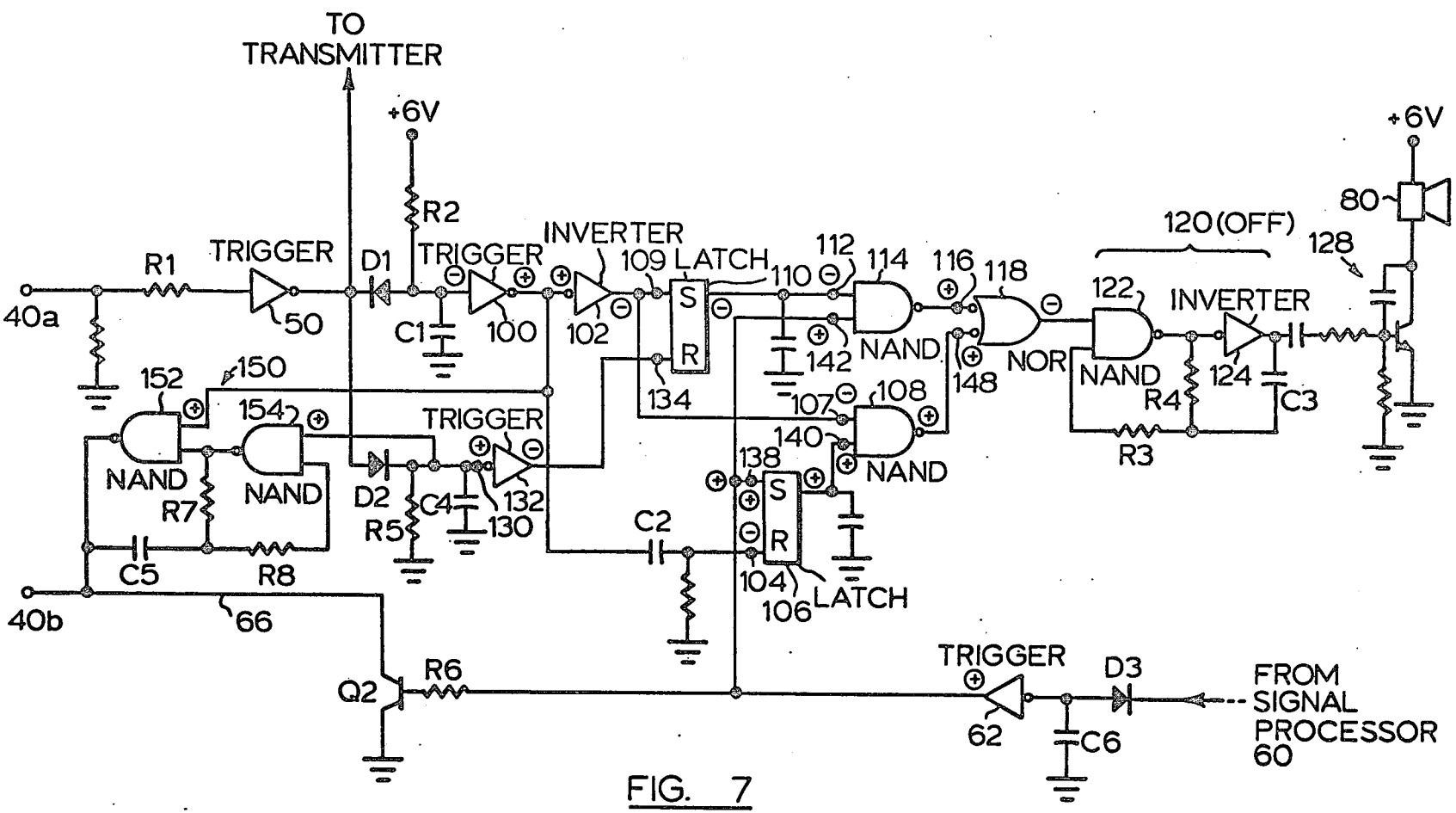
FIG. 7 shows the FIG. 6 circuit in alarm condition.

In addition, the high from Schmitt trigger 62 is applied to one input 142 of NAND gate 114 (See FIG. 7). However, since the other input 112 to gate 114 remains low (since latch 110 has not been set), the output from gate 114 remains high. There is, therefore, no change in the output of NAND gate 114 that would cause NOR gate 118 to remove the inhibit signal (a low) from oscillator 120.

The high from Schmitt trigger 62 also acts to set latch 106 (see FIG. 7) placing a high on input 140 of NAND gate 108. However, input 107 of NAND gate 108 remains low (due to inverter 102) and the output of gate 108 remains high, and again there is no change in the condition of NOR gate 118. The speaker 80 thus remains silent, so as not to alert the intruder, although an alarm has been transmitted to the master and hence to the alarm company.

D - Drive Signal OFF (Alarm Investigate or System Status)

When an authorized person responds to the alarm and arrives at the supervised premises to investigate, he will move the rocker switch 72 (FIG. 3) to its intermediate position to shut off the 40 KHz drive signal. This shuts off the transmitters of all of the satellites and prevents them from responding to further movement. In addition, when the 40 KHz drive signal is shut off, the output from trigger 50 stays high; diode D1 remains reverse biased, and capacitor C1 charges through resistor R2, producing a low at the output of trigger 100.

Figure 8:
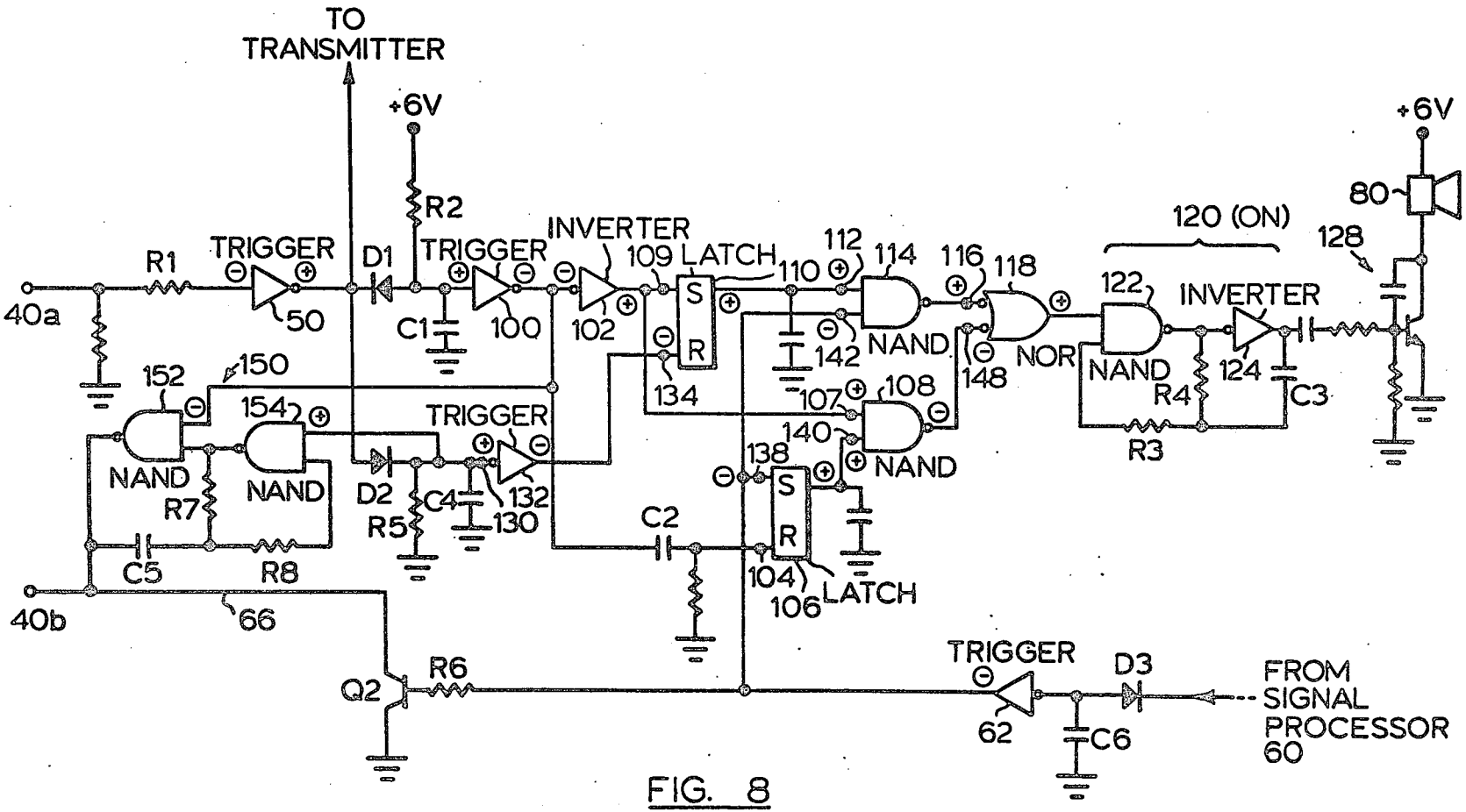
FIG. 8 shows the FIG. 6 circuit with the drive signal off.

The low at the output of trigger 100 produces a high at the output of inverter 102 (see FIG. 8) setting latch 100 and also applying a high to input 107 of NAND gate 108. Since latch 106 was set by the previous alarm pulse from trigger 60, and applies a second high to input 140 of NAND gate 108 (see FIG. 8) gate 108 now has two high inputs. Its output therefore goes low, applying a low to input 148 of NOR gate 118. The output of NOR gate 118 now goes high, enabling oscillator 120. The output of the oscillator 120 is amplified by amplifier 128 and is fed to speaker 80. Thus, when the investigator reaches the area which the satellite 1 supervises, he will hear its speaker and will know that the intruder was in that area or that it generated a false alarm. If the speakers of any other satellites are sounding, he will also know that these satellites generated alarm signals. No other alarm signals will be generated, because the 40 KHz driving signal has been turned off. It will be seen that speaker 80 sounded when two conditions occurred, namely (1) an intrusion was previously detected, and (2) the 40 KHz drive signal was turned off.

E - Walk Test

After the investigation has been completed, it will normally be desired to walk test the system, to ensure that it is operating properly. At this time, the rocker switch 72 (FIG. 3) is moved so that its rocker element 74 contacts terminal 78. This turns on the 40 KHz drive signal again, again discharging capacitor C1.

Figure 9:
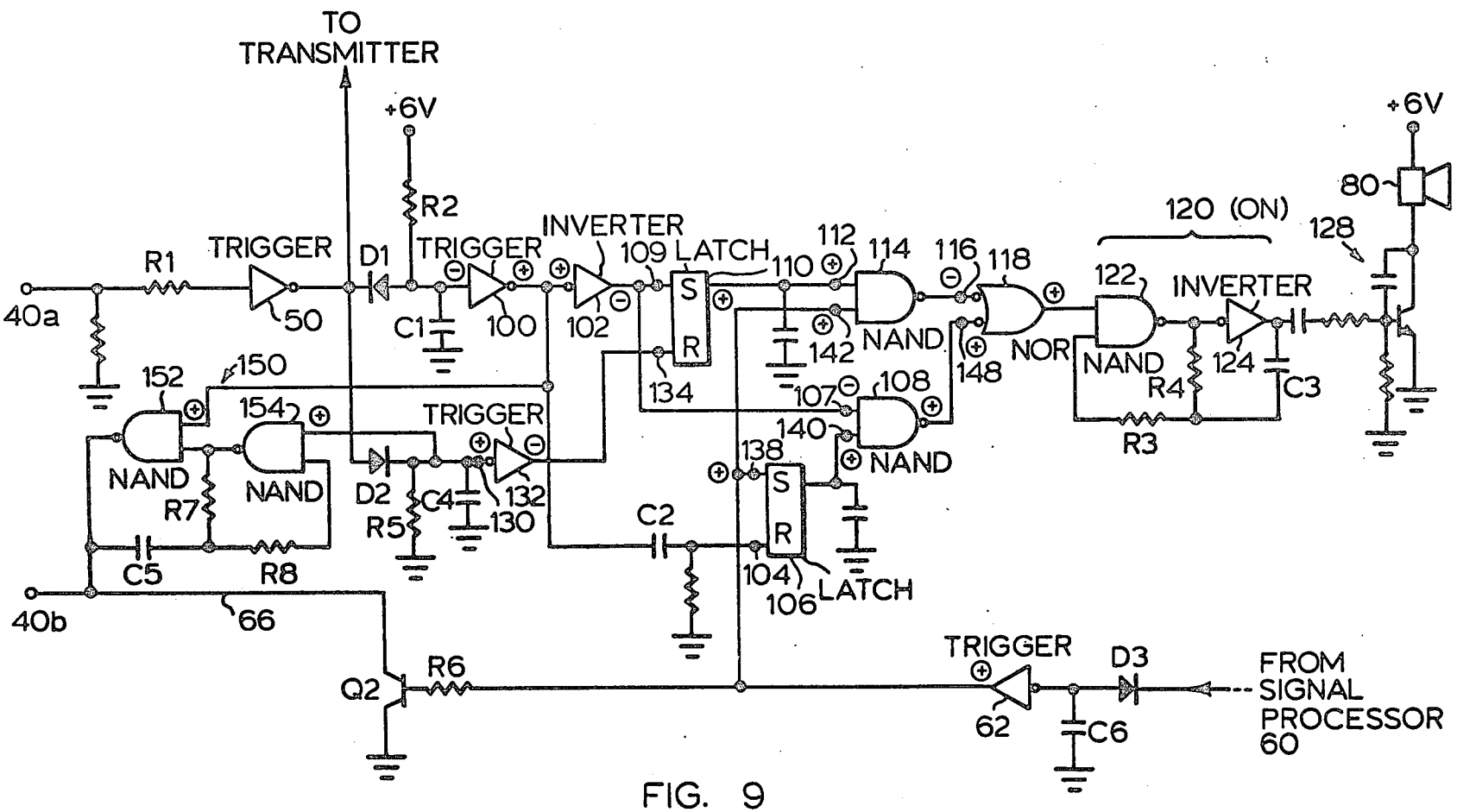
FIG. 9 shows the FIG. 6 circuit in walk test condition.

When capacitor C1 is discharged, trigger 100 goes high (see FIG. 9), resetting memory latch 106 through capacitor C2. Now, with the 40 KHz drive signal available to the satellites, when the authorized person moves in the area supervised by the satellite 1, a high is produced by trigger 62 and is fed directly to input 142 of NAND gate 114. The other input 112 to NAND gate 114 is also high, since latch 110 was set when the 40 KHz drive was turned off previously. The two high inputs to NAND gate 114 produce a low at its output. This low is applied to input 116 of NOR gate 118, which then removes the inhibit from the oscillator 120. The result is that the speaker 80 sounds during the time when the authorized person is actually moving in the area under supervision. This enables testing of the satellite in question and also facilitates setting of the levels at which it will generate an alarm signal.

F - Return to Supervisory Condition

After the walk testing has been completed, and the system is to be placed back into its supervisory condition, the rocker switch 72 is returned to its original conditon shown in FIG. 3. By means to be described, this produces a timed 0.4 second low signal on drive conductor 42, followed by a timed 0.4 second high signal, followed by the normal 40 KHz drive signal. The timed 0.4 second high signal is sufficient for capacitor C1 to discharge to its normally discharged condition and is also sufficient time for capacitor C4 to discharge through resistor R5, causing the output of the second trigger 132 to go high. This places a high signal on the reset terminal 134 of latch 110, resetting this latch and thereby disabling any further enunciation of the speaker 80. When the 40 KHz drive signal resumes, after the timed signals, the system is back in supervisory condition.

G- Description of Master Logic Circuit (i) Supervisory

Figure 10:
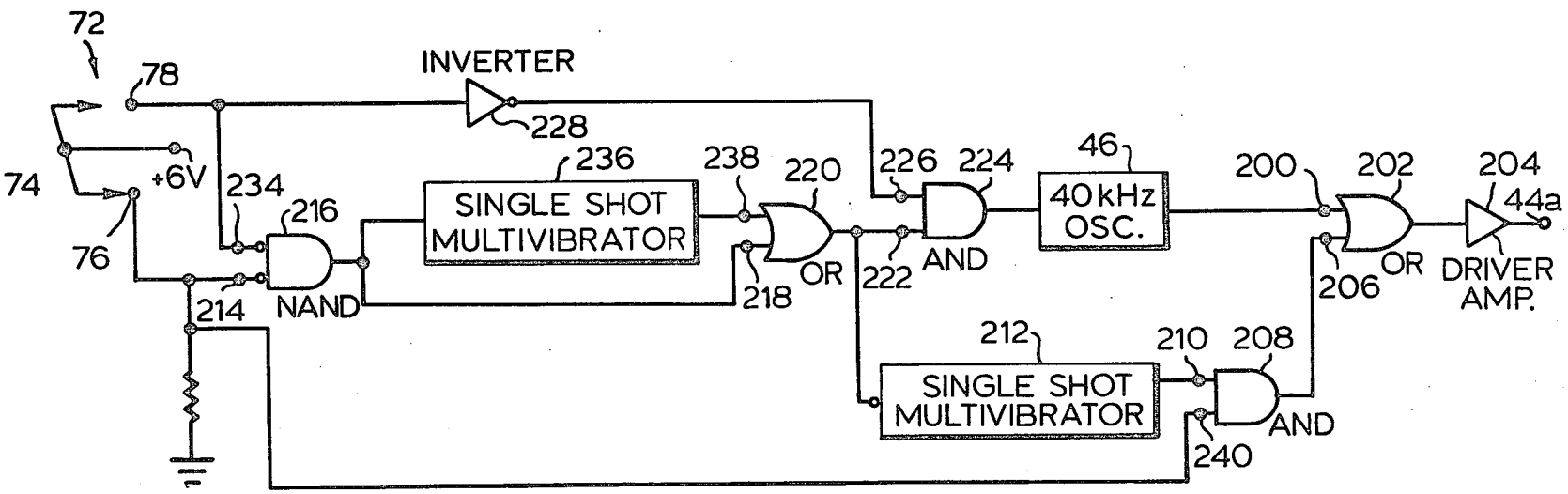
FIG. 10 is a schematic of a logic circuit of a master control unit.
Figure 11:
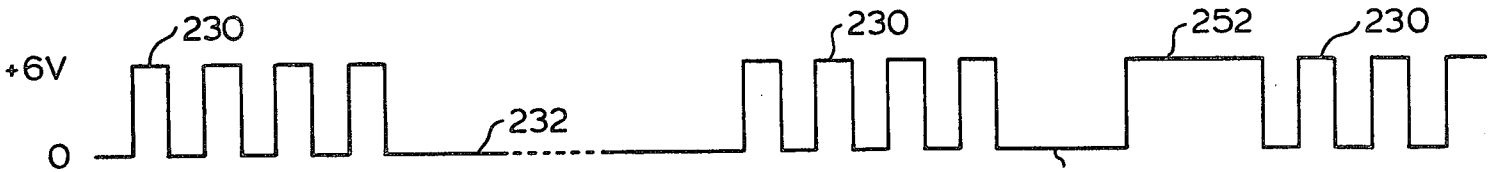
FIG. 11 shows wave forms produced by the logic circuit of FIG. 10.

The logic circuit 48 of the master 22, and the wave forms produced thereby, are shown in detail in FIGS. 10 and 11. When the rocker switch 72 is in the position shown the 40 KHz oscillator 46 operates and its signal is fed to input 200 of OR gate 202 to operate driver amplifier 204. Amplifier 204 then feeds the amplified 40 KHz drive signal to the drive terminal **44*a*. There is no input to the second input 206 of OR gate 202 at this time, because input 206 is fed by AND gate 208, one input 210 of which is a single shot multivibrator 212** which is not operative at this time.

(ii) Alarm Investigation (System Status)

When the rocker switch 72 is operated so that its rocker element 74 is in its intermediate position, in hich element 74 does not contact either terminal 76, 78, then +6 volts is removed from the second input 214 of NAND gate 216. Gate 216 is a negative logic NAND gate which produces a high at its output only when its inputs are low, i.e. it functions like a positive logic NOR gate. Both the inputs of NAND gate 216 are now low, thereby producing a high at the input 218 of OR gate 220, which in turn produces a high at the input 222 of AND gate 224. The second input 226 of AND gate 224 is also high at this time, because of inverter 228, the input of which is grounded through resistor R10. The output of AND gate 224 therefore goes high, inhibiting the 40 KHz oscillator 46, which ceases operation. When oscillator 46 turns off, the drive terminal **44*a* is grounded by means not shown in the driver amplifier 204**.

The wave forms thus produced at drive terminal **44*a* are shown in FIG. 11. The 40 KHz drive signal is shown at 230, and the ground signal produced when the 40 KHz oscillator 46 is inhibited is shown at 232. As described, when the 40 KHz oscillator 46** is inhibited, an investigator can walk into the supervised area without causing a further alarm.

(iii) Walk Test

When the rocker switch 72 is switched to its walk test condition, in which rocker element 74 contacts terminal 78, this supplies a high to the input of inverter 228, causing its output to go low, so that input 226 of AND gate 224 goes low. AND gate 224 therefore removes the inhibit of high signal from oscillator 46, and the drive terminal 44*a* now receives the 40 KHz drive signal again. As previously described, the satellites will now detect motion and the speakers 80 will sound at the time when the motion occurs, so that the system can be walk test. In addition, input 234 of NAND gate 216 goes high and input 214 of this gate goes low, causing the output of gate 216 to go low.

(iv) Return to Supervisory Condition

To return the system back to supervisory position, the rocker switch 72 is returned to its position as shown in FIG. 10. As the rocker element 74 moves, both inputs 214, 234 to NAND gate 216 are low for a brief interval. The output of gate 216 therefore goes high for a brief interval and triggers a single shot multivibrator 236 which produces a 0.4 second high output pulse. This high pulse at input 238 of OR gate 220 produces a 0.4 second high at input 222 of AND gate 224. AND gate 224 now has two high inputs (input 222 from OR gate 220 and input 226 from inverter 228), so the 40 KHz oscillator 46 is inhibited for 0.4 seconds. The 0.4 second off pulse in the drive signal is indicated at 250 in FIG. 11.

When the single shot multivibrator 236 times out, and since by this time switch 72 will have reached the position drawn, the output of OR gate 220 goes low again, since it will have lows at both its inputs. The low output of OR gate 220 triggers the second single shot multivibrator 212. Multivibrator 212 produces a 0.4 second high pulse at its output. AND gate 208 now has two high inputs, namely input 210 from multivibrator 212, and the other input 240 supplied directly from terminal 76 and the +6 volts supply. AND gate 208 therefore produces a high output for 0.4 second (the timing duration of multivibrator 212) and this applied to input 206 of OR gate 202, produces a high at its output. The high output or OR gate 202, fed to the driver amplifier 204, produces a high pulse 252 (FIG. 11) at drive terminal 44*a* for the timing duration of multivibrator 212 (0.4 seconds).

As soon as multivibrator 212 times out, the high input to input 206 of OR gate 202 is removed, and the normal 40 KHz drive signal 230 is reapplied to the drive terminal 44*a*. The system is now back in normal supervisory operation.

In the system described, it will be seen that the alarm signal transmitted by the satellites to the master is a high level signal, i.e. it is the removal and continued absence of the high level signal produced by oscillator 150. A "high level" alarm signal as here used means a signal which differs by a reasonably substantial amount from the previously prevailing signal, so that even if the signal conductor is unshielded, it will not normally pick up stray signal that would be interpreted as an alarm signal. For example, the difference will usually be at least one volt and preferably higher in a cable of length not exceeding 500 feet. For longer cables, a higher difference will usually be employed. Here, +6 volts has been used for a system in which the cable length is typically up to 1000 feet.

It will also be appreciated that certain features of the invention may be used in systems which transmit low level signals over shielded cables containing more than four conductors. For example, the feature of inhibiting the speaker of a satellite which has detected a disturbance, until the drive signal is turned off, the termination of the drive signal causing that speaker (or other alarm indicator) then to annunciate may be used in other systems, as may the walk test feature.

H - Tamper Switch

In the system so far described, it is possible that an expert could tamper with a satellite during the day (when signals produced by the alarm signal generator are not normally monitored) and could disable the satellite in a manner such that it would continue to transmit a 10 Hz supervisory signal to alarm signal terminal 40*b*, but would not ground this terminal when an intruder is detected. To prevent this possibility, it is required in some systems that a tamper switch be installed in each satellite. Such a tamper switch operates when the cover of the satellite is removed and causes generation of a tamper alarm signal which is monitored 24 hours per day. In the past, the installation of a tamper switch has required addition of a separate pair of wires from each satellite to the master control unit.

According to the invention, a tamper switch system is provided which utilizes the alarm signal terminal 40*b* and the alarm conductor 42*b*. The original four wire cable 32 is still used; no additional conductors are required. The tamper switch system will be described next, with reference to FIGS. 12 to 16.

Figures 12, 13:
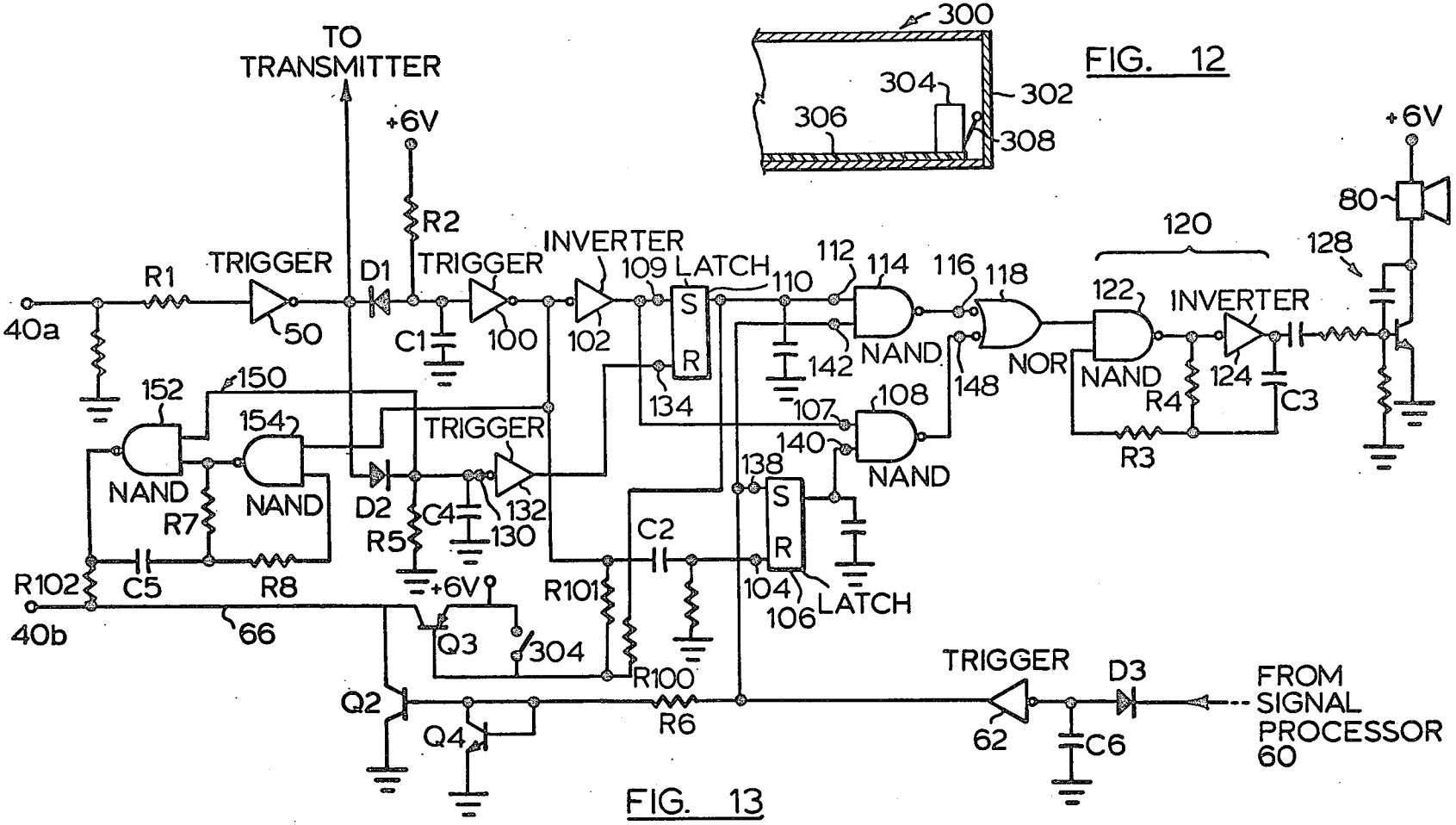
FIG. 12 is a diagrammatic view of the housing of a satellite showing a tamper switch in position therein.
FIG. 13 is a schematic of a control circuit of the satellite of FIG. 12, similar to FIG. 4 but showing the tamper switch circuitry in position.

Reference is first made to FIG. 12, which shows a typical housing 300 for a satellite. The housing 300 includes a cap or cover 302 secured to the remainder of the housing by means not shown and which must be removed if access is desired to the inside of the housing. Located within the housing 300 is a microswitch 304, which constitutes a tamper switch. The tamper switch 304 is secured (by means not shown) on a circuit board 306 which also contains the remainder of the circuitry for each satellite. Projecting from the tamper switch 304 is a spring biased switch element 308 which normally rests against the cover 302. If the cover 302 is removed, the switch element 308 will move outwardly, opening the tamper switch, as will now be described with reference to FIG. 13.

FIG. 13 shows the same control circuit as that of FIG. 4, except for the addition of the tamper switch 304 and associated circuitry, and except for a reversal of the inputs to NAND gates 152 and 154, for a reason to be explained. In FIGS. 13 to 16, corresponding reference numerals are used to indicate parts corresponding to those of FIGS. 1 to 11.

In the FIGS. 1 to 11 system, and also in the FIGS. 13 to 16 system, a supervisory 10 Hz signal is normally applied to alarm terminal 40*b* by oscillator 150. The 10 Hz signal oscillates between ground and +6 volts. When a satellite detects an intruder, that satellite's transistor Q2 grounds its alarm terminal 40*b*. The ground constitutes a high level alarm signal and is detected by detector 68 (FIG. 3). (It may be noted that normally only the oscillator 150 in the last satellite of each group of satellites is coupled to the drive signal terminal 40*a* for operation. For example, in satellite group 24 of FIG. 1, only the oscillator 150 of satellite 5 would be connected. This ensures that all the lines are fully supervised. If oscillators 150 of all of the satellites in the group were connected, then the line to one satellite could be cut without this being detected.)

The tamper switch 304, when it opens, causes a different high level alarm signal to be applied to the alarm terminal 40*b* of its satellite. Specifically, tamper switch 304 when it opens causes a +6 volt signal to be applied to alarm signal terminal 40b. The operation is as follows.

In normal supervisory condition, and with the cover 302 closed on housing 300, tamper switch 304 is normally closed. In the normal supervisory condition (section B of the foregoing description), latch 110 is not set, and its output, being low, causes current to flow in resistor R100. This current flows directly through switch 304 to the +6 volt supply, since switch 304 short circuits the base-emitter junction of transistor Q3.

If the cover 302 is now removed, allowing switch 304 to open, the current through resistor R100 will then flow into the base of transistor Q3, turning it on. Transistor Q3 pulls the alarm terminal 40b up to +6 volts. The +6 volt signal at terminal 40b constitutes a tamper alarm signal which, when transmitted to the master, is detected as will be described.

When several satellites are connected to a single master control unit, the following situation may occur. During the day, when persons are moving about the premises being supervised, several or all of the satellites may transmit alarms by grounding their respective alarm terminals 40b through their respective transistors Q2. If at this time one satellite is tampered with and its transistor Q3 attempts to pull its terminal 40b (and the corresponding master terminal 44b) up to +6 volts, this tendency will be counteracted by those satellites which have their transistors Q2 turned on. To ensure that the master control unit terminal 44b is pulled up to +6 volts or to a voltage near +6 volts, means are provided to limit the current through transistor Q2 of each satellite. These means are constituted by transistor Q4 (FIG. 13) which is connected with transistor Q2 to form a current mirror. In this configuration, provided that transistors Q2 and Q4 are well matched, the collector current of transistor Q2 is essentially the same as the current flowing through resistor R6. This current is sufficiently limited that even if transistors Q2 of all five satellites connected to a master control unit are conducting, operation of a transistor Q3 of one of the satellites will pull terminal 44b of the master control unit sufficiently close to +6 volts to operate the tamper switch detector therein (as will be described).

If the 40 KHz drive signal is turned off (section D of the foregoing description), the tamper alarm signal will still be operative. In this condition, latch 110 is set (FIG. 8) and its output is high, so that base current for transistor Q3 cannot be supplied from latch 110. However, the output of trigger 100 is now low, and if tamper switch 304 is open, current flows through resistor R101 to the base of transistor Q3, again turning on transistor Q3.

It should be noted that in the control circuit shown in FIGS. 6 to 9 inclusive, when the drive signal is turned off (section D of the foreging description), alarm terminals 40b of the satellites normally went to +6 volts (this was the quiescent condition of the oscillators 150). With the tamper switch 304 included in the circuit, this was undesirable. Therefore, as shown in FIG. 13, the input to NAND gates 152, 154 of oscillator 150 have been reversed. The upper input to NAND gate 152 is now connected to the cathode of diode D2, and the upper input to NAND gate 154 is now connected to the output of trigger 100. This reversal of the inputs causes the output of oscillator 150, and hence terminal 40b of the satellites, to be grounded through resistor R102 when the drive signal is turned off. If at this time a tamper switch 304 operates, its transistor Q3 will counteract the effect of oscillator 150 and will pull terminal 40b to +6 volts.

When the system is being walk tested (section E of the foregoing description), tamper circuit operation is not desirable. This is because it is often desired to adjust the sensitivity of the satellites during the walk testing, and the covers 302 may be removed at this time.

In the walk test condition, the outputs of both trigger 100 and latch 110 are high (FIG. 9) and therefore no current is available to operate transistor Q3. Thus, the tamper alarm will not be operative.

Figure 14:
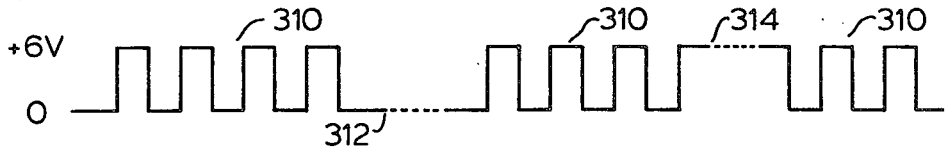
FIG. 14 shows wave forms on the alarm line of the FIG. 13 circuit.

The signals applied to terminal 40b of a satellite are shown in FIG. 14. The normal supervisory 10 Hz signal supplied by oscillator 150 of the last satellite of each group is shown at 310 and oscillates between zero and +6 volts. When one satellite detects an intruder, the ground signal applied to terminal 40b is shown at 312. When a satellite cover is removed, the +6 volt tamper alarm signal is shown at 314.

Figure 15:
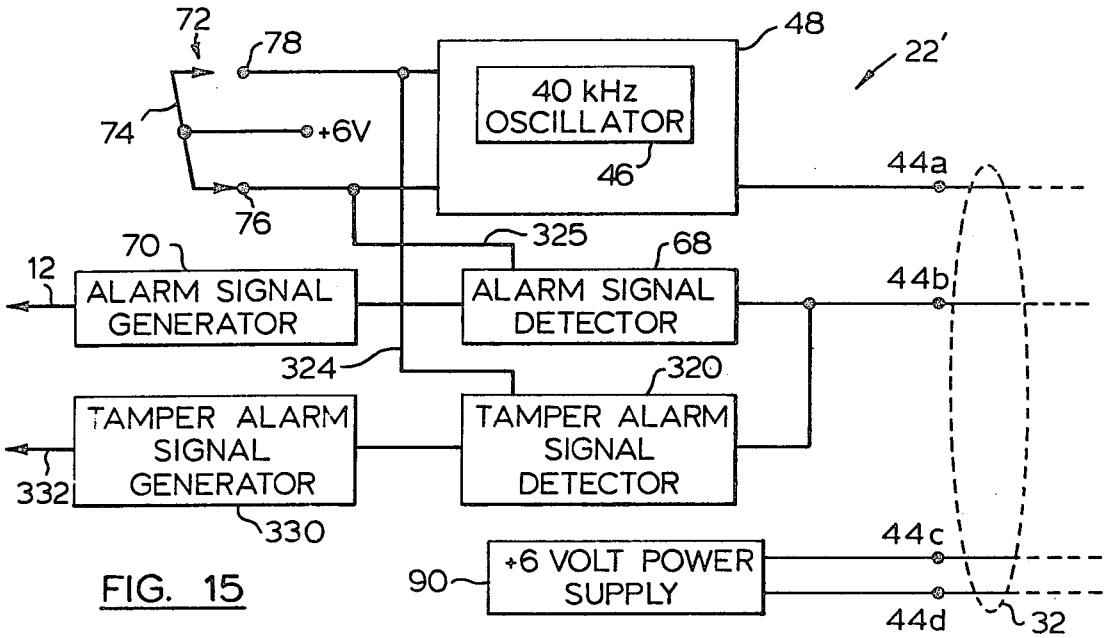
FIG. 15 is a block diagram of a master control unit for use with the FIG. 13 circuit.

Reference is next made to FIG. 15, which shows the master control unit used when the satellites include tamper switches. The master control unit of FIG. 15 is the same as that of FIG. 1 except for minor changes as will be described, and corresponding parts are indicated by corresponding reference numerals. The master control unit as a whole in FIG. 15 is indicated by reference numeral 22'.

The differences between the master control unit 22' and master control unit 22 of FIG. 2 are as follows. Firstly, a tamper alarm detector 320 has been added. The tamper alarm detector 320 is connected to alarm terminal 44b of the master control unit 22' and is also connected via conductor 324 to terminal 78 of rocker switch 72, to alert the supervising station if the rocker switch is moved (as will be described).

In addition, lead 82 from the rocker switch 72 to alarm signal generator 70 has been replaced by a similar lead 325 from rocker switch 72 to the alarm signal detector 68.

When a tamper switch 304 operates, operating a tamper alarm signal detector 320, detector 320 in turn operates a tamper signal generator 330 which transmits an appropriate signal via lead 332 to an alarm company, to police headquarters or to another supervising station as desired.

Figure 16:
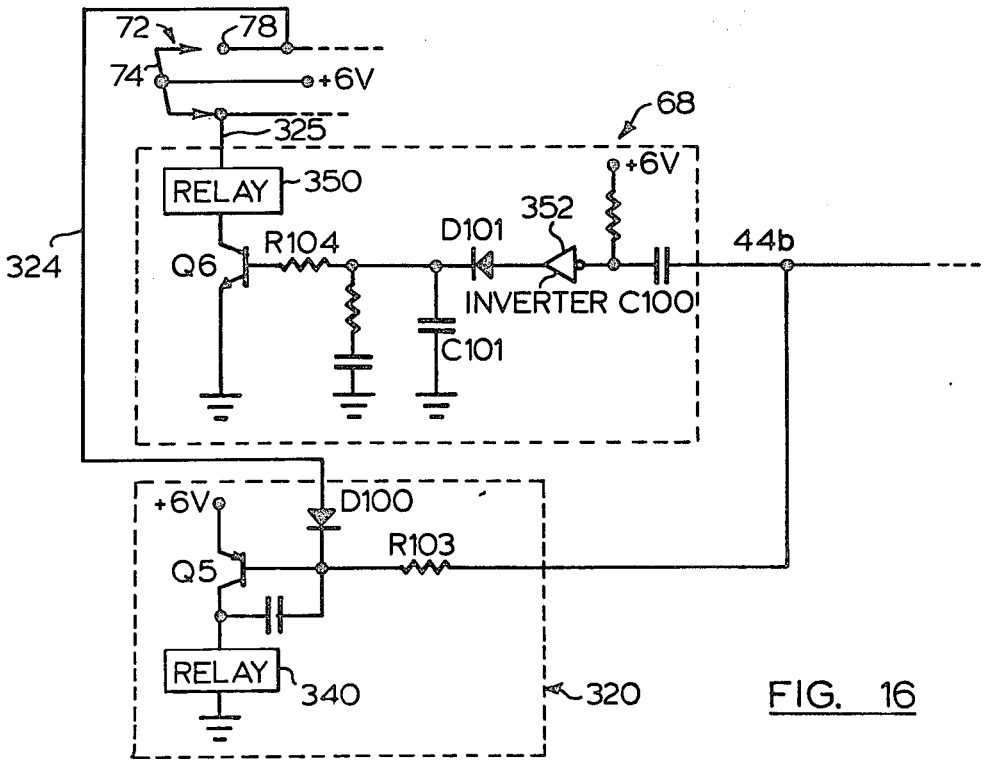
FIG. 16 is a schematic of a portion of the control unit of FIG. 15.

Detailed circuits for the alarm signal detector 68 and the tamper alarm signal detector 320 are shown in FIG. 16. As shown, the tamper alarm signal detector 320 includes a tamper relay 340. So long as alarm terminal 44b is low (which occurs when the drive signal is turned off or when an ordinary alarm occurs), the current through resistor R103 is sufficient to turn on transistor Q5 and maintain the tamper relay 340 energized. Similarly, so long as the system is in supervisory condition, with the drive signal on, the average current generated by the 10 Hz square wave applied to terminal 44b is also sufficient to turn on transistor Q5, again maintaining the tamper relay 340 energized.

When a tamper switch 304 operates, this will cause terminal 44b to go high (+6 volts), removing the current from transistor Q5 and turning off relay 340. A contact of relay 340 (not shown) then operates the tamper alarm signal generator 330.

If the rocker switch 72 is placed in walk test condition, in which rocker arm 74 contacts terminal 78, the base current of transistor Q5 is by-passed through diode D100, again turning off the tamper relay 340 to alert the supervising station of this condition.

The alarm signal detector 68 shown in FIG. 16 will next be described. Detector 68 includes an alarm relay 350 which is normally energized by transistor Q6. The base of transistor Q6 is connected through resistor R104, diode D101, inverter 352 and capacitor C100 to the alarm terminal 44*b*. So long as the 10 Hz supervisory signal is received at terminal 44*b*, terminal 44*b* will oscillate between zero and +6 volts, keeping capacitor C101 charged through diode D101. So long as capacitor C101 remains charged, sufficient base current is provided for transistor Q6 to keep transistor Q6 turned on, keeping alarm relay 350 energized. However, if terminal 44*b* remains in either a high or low state, current will cease to flow through capacitor C100, and transistor Q6 will turn off, turning off alarm relay 350. Relay 350 will also turn off if rocker switch 72 is moved from its supervisory condition shown in FIG. 16, since the +6 volts supply is then removed from the relay. When relay 350 turns off, its contact (not shown) operates the alarm signal generator 70.

It will be seen that in the FIGS. 13 to 16 embodiment, the single alarm conductor 42*b* is used to transmit a high level supervisory signal (10 Hz), a high level alarm signal (ground), and a high level tamper alarm signal (+6 volts). Because one wire is used for all three signals, a tamper switch can be added without additional wiring between the master and the satellites, thus greatly simplifying the installation.

I—Satellite Annunciate Control Circuit

Figure 17:
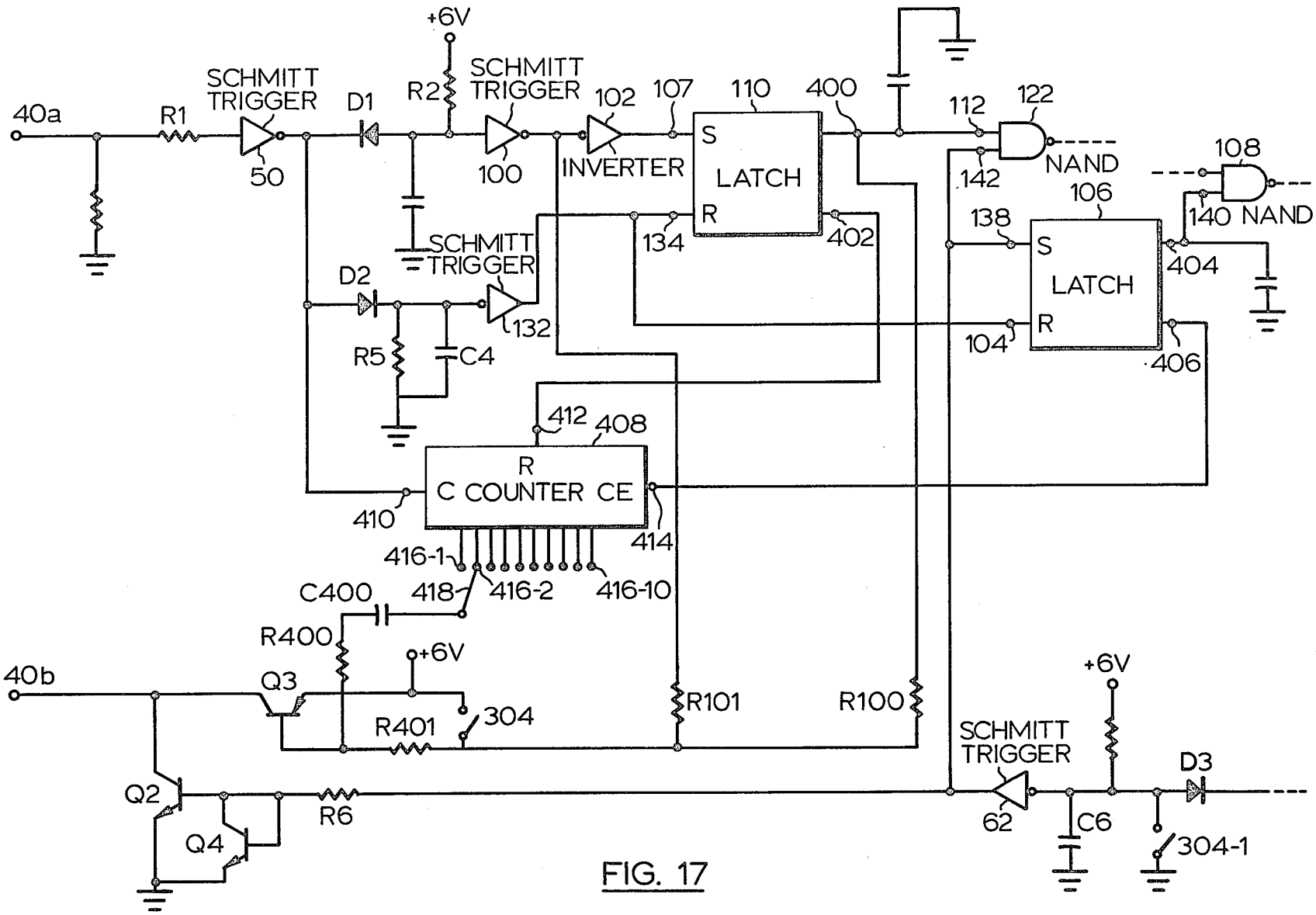
FIG. 17 is a schematic showing a portion of a satellite control circuit with annunciating means added according to the invention.

Reference is next made to FIG. 17, which shows a portion of the satellite control circuit 64 but with the annunciation feature of the invention added. In the FIG. 17 arrangement, the satellite control circuit 64 is unchanged from that of FIG. 13, except for the specific elements now described.

As shown in FIG. 17, latch 110 is now indicated as having an output terminal 400 (which is the terminal connected to NAND gate 114) and a second output terminal 402. Similarly, latch 106 is shown as having an output terminal 404 (which is the terminal connected to input 140 of NAND gate 108) and a second output terminal 406.

The satellite control circuit 64 further includes a ten stage counter 408 having a clock terminal 410 connected to the output of trigger 50, a reset terminal 412 connected to the output terminal 402 of latch 110, and a clock enable terminal 414 connected to the output terminal 406 of latch 106. The counter 408 also has ten output terminals 416-1 to 416-10 inclusive. A jumper lead 418 is connected from a selected one of the terminals 416-1 to 416-10, through capacitor C400 and resistor R400 to the base of transistor Q3. The junction of resistor R400 and the base of transistor Q3 is now connected through a resistor R401 to the normally closed tamper switch 304.

The operation of the annunciation circuit shown in FIG. 17 is as follows. When annunciation of the satellites is desired, the master control unit 22 is placed in its alarm investigate or system status mode (part D of the foregoing description). This shuts off the drive signal to each satellite to be interrogated, causing latches 110 to be set as described. When each latch 110 is set, its terminal 402 goes low, removing the reset signal from reset terminal 412 of counter 408. In addition, if a satellite has recorded an alarm, its latch 106 will be set as described in part C of the foregoing description. This produces a low at the output terminal 406 of latch 106, enabling the clock enable terminal 414 of the counter 408.

Next, by means to be described, a set of ten clock pulses is transmitted from the master control unit 48 to the drive terminals 40*a* of the satellites to be interrogated. When the clock pulses are received by the counter 408, the counter 408 then counts (assuming that its clock enable terminal 414 has been enabled by the setting of latch 106) and the counter outputs 416-1 to 416-10 successively go high and then low as the count proceeds.

In the example shown, the jumper cable 418 is connected to counter output terminal 416-2. Therefore, at the second count, when terminal 416-2 goes high, a high pulse is transmitted through capacitor C400 and resistor R400 to the base of transistor Q3. When this high pulse ends at the end of the second count, the negative-going step turns on transistor Q3 for a brief interval. This pulls alarm terminal 40*b* high (+6 volts), transmitting a brief high signal from alarm terminal 40*b* to the master control unit for use as will be described. Each satellite will have its jumper cable 418 connected to a different counter terminal 416-1 to 416-10.

J - Master Control Unit Annunciating Circuit

Figure 18:
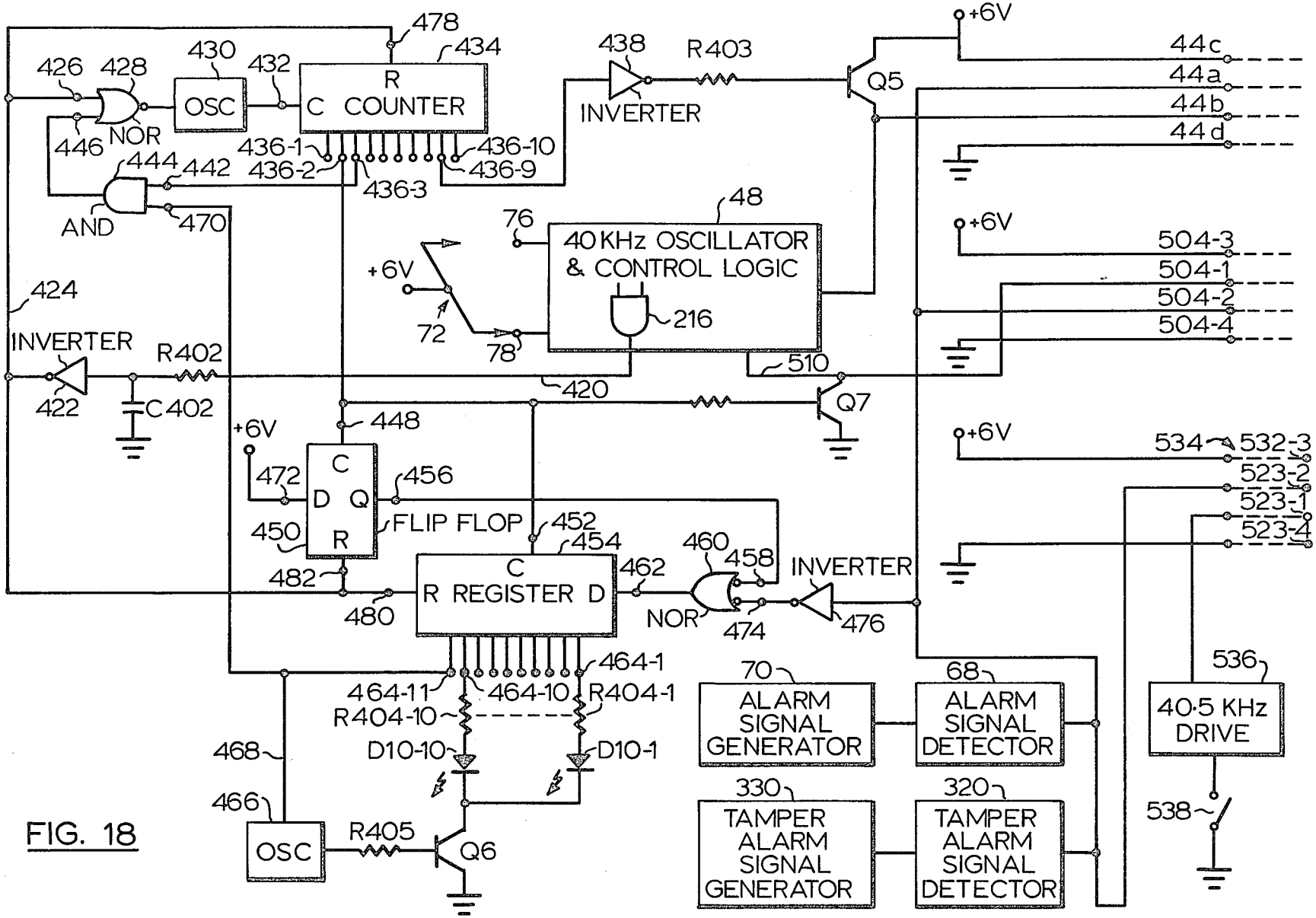
FIG. 18 is a schematic showing a portion of the master control unit of FIG. 15 but having an annunciating control added according to the invention.

Reference is next made to FIG. 18, which shows the annunciating circuit which has been added to the master control unit 48. As shown, the annunciating circuit includes a conductor 420 which is connected from the output of NAND gate 216 (FIG. 10) through a combination of resistor R402 and capacitor C402 to an inverter 422. The output of inverter 422 is connected via conductor 424 to the input 426 of a NOR gate 428. The output of NOR gate 428 is connected to an oscillator 430. The output of the oscillator 430 is connected to the clock terminal 432 of a ten stage counter 434.

Counter 434 has ten outputs 436-1 to 436-10 inclusive. Only three of these outputs are used. Output 436-9 is connected through inverter 438 and resistor R403 to the base of transistor Q5. The collector of transistor Q5 is connected at junction 446 to the drive terminal 44*a* of the master control unit. Counter output 436-3 is connected to input 442 of AND gate 444, the output of which is connected to input 446 of NOR gate 428. Output 436-2 of the counter is connected to the clock terminal 448 of a D-type flip-flop 450 and also to the clock terminal 452 of an eleven stage shift register 454. The Q output 456 of the flip-flop 450 is connected to input 458 of a negative logic NOR gate 460, the output of which is connected to the D or input terminal 462 of register 454.

Register 454 has eleven outputs, indicated at 464-1 to 464-11 inclusive. Outputs 464-1 to 464-10 are connected through resistors R404-1 to R404-10 and light emitting diodes D10-1 to D10-10 respectively to the collector of a transistor Q6. The base of transistor Q6 is connected through resistor R405 to an oscillator 466 which is enabled through conductor 468 connected to register output terminal 464-11. Terminal 464-11 is also connected to input 470 to AND gate 444.

K - Operation of Master Control Unit Annunciating Circuit

(i) Turn-on of Clock Pulses

The annunciating circuit of FIG. 18 will best be understood from a description of its operation, which is as follows. When an investigator at the protected premises wishes to determine the status of the satellites, he moves the rocker switch 72 to its intermediate position as described in parts D and G (ii) of the foregoing description. This shuts off the drive signal to the satellites, removing the resets from their counters 408 as described.

In addition, the movement of the rocker switch 72 causes the output of NAND gate 216 (FIG. 10) to go high. The high signal is conducted along conductor 420, delayed slightly by resistor R402 and capacitor C402, inverted by inverter 422, and the resultant low signal is applied to input 426 of NOR gate 428. Since the other input 446 of NOR gate 428 is low at this time (as will be explained), the output of NOR gate 428 is high, enabling oscillator 430. Oscillator 430 then operates, operating counter 434. The delay produced by resistor R402 and capacitor C401 before counter 434 begins to operate allows time for the satellites to switch to their annunciate condition before pulses are generated by the counter.

(ii) Transmission of Clock Pulses to Satellites

When the counter 434 operates, a set of clock pulses, at 1/10th the frequency of the oscillator 430, is transmitted via counter output 436-9, inverter 438 and transistor Q5 to drive terminal **44*a* (where they appear as high pulses) and hence to the satellites of the zone connected to the master control unit shown. The situation is illustrated in FIG. 19*a*, in which the 40 KHz drive signal is indicated at 230 and its termination is indicated at 800. The normally high reset signal from terminal 402 of latch 110 (FIG. 17) is indicated at 802 in FIG. 19*b*, and this signal goes low at 804, shortly after the drive to the satellite ceases. The ten clock pulses, indicated at 806-1 to 806-10 in FIG. 19*a*, then occur. Each clock pulse is typically 0.1 millisecond in duration and is separated by a space of about 1 millisecond. Assuming that satellites nos. 2 and 7 in the zone have recorded alarms, the outputs at their counter output terminals 416-2 and 416-7 are shown respectively at 808 and 810 in FIGS. 19*c* and 19*d* respectively. Such outputs are not greater in duration than the duration of a count. The resultant high pulses on the alarm terminal 44*b* of the master control unit (produced by the negative going step at the ends of pulses 808, 810) are shown at 812 and 814 of FIG. 19*e*** and are of course not greater than the duration of a count.

(iii) Counter Control of Shift Register

When the counter 434 (FIG. 18) receives its second pulse from oscillator 430, and before the count reaches 9 (at which time a pulse is sent to terminal **44*a*), terminal 436-2 of the counter goes high for the duration of the second pulse. Output 436-2, since it is connected to the shift register clock terminal 452, forms a clock for the register 454. In addition, when output 436-2 goes high, the high applied to terminal 448 of flip-flop 450 permits the high at input 472 of flip-flop 450 to set the flip-flop. This produces a high at output 456 of flip-flop 450** and this high remains until the flip-flop is reset.

When output 436-2 of counter 434 first goes high, it causes a "1" to be entered into register 454 in the following manner. When the first high from terminal 436-2 clocks the register 454, the output at terminal 456 of flip-flop 450 is low (since a finite time is required for the first high from terminal 436-2 to reset flip-flop 450). The low at terminal 456 is applied to terminal 458 of negative logic NOR gate 460. Since a low at either or both inputs of NOR gate 460 produces a high at its output 462, a high or "1" (which will become an overflow signal) is therefore entered into the register 454 at the time of the first clock pulse from terminal 436-2. However, since this first clock pulse has also set the flip-flop 450, causing output 456 to go high, therefore no further "1's" can be entered into the register unless the other input 474 to NOR gate 460 goes low, as will now be explained.

When the counter 434 has received nine pulses from oscillator 430, a first clock pulse is sent from terminal 436-9 to terminal **44*a* and hence to the satellites. If the satellite which has its jumper cable 418 connected to its counter terminal 416-1 has registered an alarm condition, then when this first clock pulse or count is received, that satellite's transistor Q3 will operate for a brief interval, pulling its alarm terminal 40*b* high. The high signal is transmitted to terminal 44*b* of the master control unit, is inverted by inverter 476 (FIG. 18), and the resultant low is applied to terminal 474 of negative logic NOR gate 460. This causes another "1" to be entered into the register 454 (and the previous "1" is shifted to the next position in the register). If the satellite having its jumper cable 418 connected to its counter terminal 416-1 has not registered an alarm condition, then that satellite's terminal 40*b* would be low; terminal 44*b* of the master control unit would be low, and a high would be present at terminal 474 of NOR gate 460. With two highs at its inputs, the output of negative logic NOR gate 460 would be low, causing a "0" to be entered into register 454**.

After 10 clock pulses have been transmitted from counter terminal 436-9 in the master control unit to the satellite, the maximum of 10 satellites in the zone have been interrogated (more satellites could be interrogated with larger counters and a larger register). Then, on the next cycle, an 11th clock pulse from terminal 436-2 is applied to the register clock input 454, causing the initial "1" or overflow signal which was inserted into the register to move into the 11th position in the register. This produces a high at the register output terminal 464-11. This high is applied to the input 470 of AND gate 444. As the pulsing of counter 434 proceeds, terminal 436-3 of counter 434 next goes high, applying a high to the second input 442 of AND gate 444. The resultant high at input 442 of NOR gate 428 causes a low at the output of this NOR gate, inhibiting the oscillator 430. The counter 434 therefore stops at pulse 3, and no further interrogating pulses are applied to drive terminal **44*a***.

In addition, the high at terminal 464-11 of the register enables oscillator 466. Oscillator 466 then turns transistor Q6 on and off at a predetermined frequency (for example 1 Hz). This causes those diodes D10-1 to D10-10 which are connected to register output terminals which have recorded highs to flash on and off. The investigator, by viewing the flashing diodes, will then see which satellites have recorded alarms.

It may be noted that although the initial alarm signal which was sent to the master control unit 48 when an intruder was detected was constituted by a ground applied to terminal **40*b* of the satellite in question, the satellites when subsequently interrogated by the master control unit will apply a short duration high signal to their respective terminals 40*b* to indicate that an alarm condition has been recorded. The short duration high does not operate the tamper alarm signal detector 320 (FIG. 18) since the duration of the high (one millisecond at the most, and normally much less) is too short to operate detector 320 (detector 320** normally requires a high of at least several milliseconds duration to operate).

It will be recalled that if the tamper switch 304 (FIG. 17) of a satellite opens, this normally turns on transistor Q3 and places a high on the alarm terminal 40*b* of the satellite, and this would interfere with annunciation if it occurred during annunciation. However, for transistor Q3 to turn on, it requires base current through either resistor R100 or resistor R101. During annunciation no base current is available through resistor R100 because at this time latch 100 is set and the latch output 400 is high, so no ground is available from this source to turn on transistor Q3. Resistor R101 is connected to the output of trigger 100, which output is high whenever either the 40 KHz or the annunciation pulses are being received by the satellite. Therefore the tamper switch 304, even if it has opened, does not interfere with the annunciation of alarms.

A further feature, which may be added if desired, is the ability to annunciate tamper alarms under certain conditions. It is found that while intrusion alarms usually occur at night, tamper alarms usually occur during the day, when the alarm system is in its system status mode (i.e. the 40 KHz drive is off). When such a tamper alarm occurs, it has previously been necessary to investigate each satellite in the building to see whether its case has been tampered with. However, an additional set of contacts 304-1 may now be added to the tamper switch, as shown in FIG. 17. Contacts 304-1 are normally open and close when the tamper switch 304 operates (i.e. when a tamper occurs). When contacts 304-1 close, they ground the input of trigger 62, causing a high at the output of this trigger, just like a normal alarm. This high sets latch 106, which is the alarm recording latch. At the same time, although the high from trigger 62 tends to turn transistor Q2 on, switch 304 turns on transistor Q3 which as indicated overcomes the effect of transistor Q2 and pulls alarm terminal 40*b* up to +6 volts, operating the tamper alarm signal generator 330 (FIG. 15). The operator in charge will then notice that a tamper alarm has occurred and can institute an annunciate cycle to see which satellite has been tampered with. Since the drive signal is off at this time, any satellites which have recorded alarm conditions will (unless they are malfunctioning) have done so because they were tampered with, and not because they recorded an ordinary alarm.

(iv) Reset of Annunciation System

To reset the system, the rocker switch may be moved to its walk test and then to its supervisory condition. This removes the high at the output of NAND gate 216 (FIG. 18 and also FIG. 10), removing the low signal from line 424 and hence disabling oscillator 430. The resultant high at the output of inverter 422 is applied to the reset terminal 478 of counter 434, to the reset terminal 480 of register 454, and to the reset terminal 482 of flip-flop 450, resetting all these elements in readiness for the next annunciation.

It will be appreciated that the satellites need not all receive their alarm signals from electromagnetic or ultrasonic intrusion detectors. For example, the signal processor 60 in a satellite may represent an input from a door switch, a window foil, or any other type of alarm detector. Satellites having such inputs may omit the transmitter and associated elements shown in FIG. 2. However, the remainder of the satellite will be as described.

L - Remote Annunciation

Figure 20:
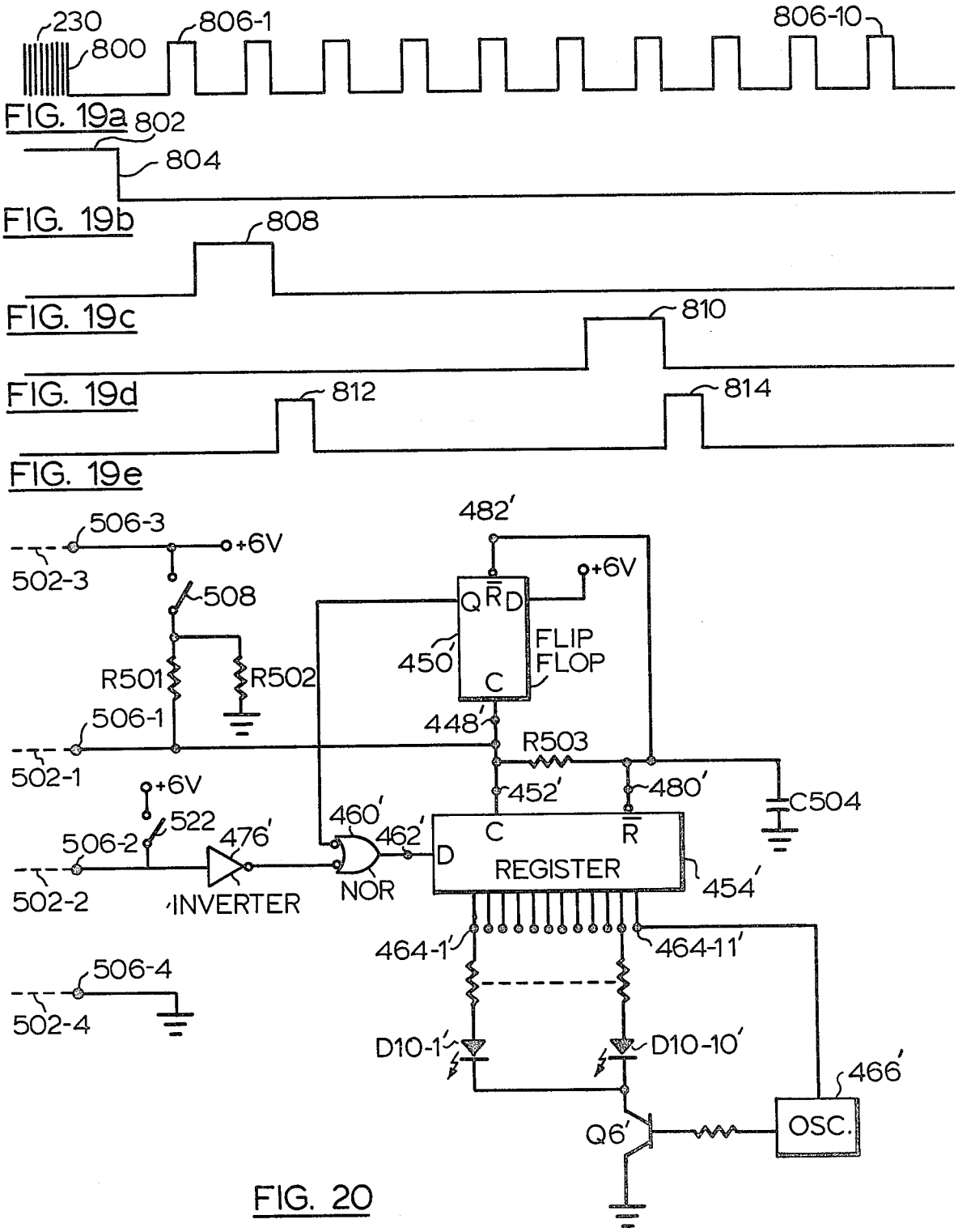
FIG. 20 is a schematic showing a remote annunciator.

The annunciation system just discussed describes the annunciation system as being located at the master control unit. In some cases it may be desired to have the annunciation system remote from the master control unit, and in that event the system shown in FIG. 20 will be used. The annunciation system of FIG. 20 is generally indicated at 500 and is essentially a partial duplicate of the system shown in FIG. 18, and primed reference numerals indicate corresponding parts in the two systems. As shown, the remote annunciation system 500 is connected to the master control unit 22 by a four wire cable 502 having conductors 502-1, 502-2, 502-3 and 502-4. Conductors 502-1 to 502-4 respectively are connected to terminals 504-1 to 504-4 respectively in the master control unit 22 and to terminals 506-1 to 506-4 respectively in the remote annunciator.

Terminal 504-1 (FIG. 18) may be termed a clock terminal and is connected to the collector of transistor Q7, the base of which is connected to counter terminal 436-2. Terminal 504-2 is an alarm terminal and is connected directly to the alarm terminal 44*b* of the master control circuit. Terminals 504-3 and 504-4 supply +6 volts and ground respectively.

In the remote annunciator 500 of FIG. 20, the register 454' and flip-flop 450' are reset by lows rather than highs, which is the inverse of the FIG. 18 arrangement. The FIG. 20 annunciator will best be understood from a description of its operation, which is as follows.

When an investigator reaches the remote annunciator 500 (which may be located outside the protected premises), he closes a key switch 508. Clock terminal 502-1, which was previously grounded through resistors R501 and R502, now goes high. The high is transmitted via conductor 510 (FIG. 18) to the logic circuit 48 of the master control unit 22 and (by means to be described) produces the same effect as if the rocker switch 72 had been moved to its intermediate position in which element 74 does not contact either terminal 76, 78. This is the alarm investigate mode of the logic circuit 48. The 40 KHz drive signal to the satellites is then shut off and a high is then sent over conductor 420 (FIG. 18) as previously described to start the oscillator 430 and counter 434.

As the counter 434 operates, its clock pulses from terminal 436-2 are reproduced by transistor Q7 as a series of low pulses which are sent over clock line 502-1 to clock the register 454' in the remote annunciator. The filter constituted by resistor R503 and capacitor C504 prevents the low pulses from resetting register 454' and flip-flop 450'. As before, the first clock pulse causes the entry of a "1" into register 454', since when the first clock pulse occurs, then Q output 456' of flip-flop 450' is low and therefore the output of NOR gate 460' is high. The entry of subsequent highs or lows into the register will depend on the state of the alarm terminal 44*b*, as previously described. After the register 454' has been clocked eleven times, the annunciator in the master control unit resets itself and no further pulses are transmitted. The light emitting diodes D10-1' to D10-10' in the annunciator 500 then indicate to the investigator the status of the satellites. The investigator then opens key switch 508, placing a low on clock terminal 506-1. This resets register 454' and flip-flop 450' and also returns the master control logic circuit to its supervisory condition in a manner which will now be described.

M - Remote Annunciator - Operation of Master Logic Circuit

Figure 21:
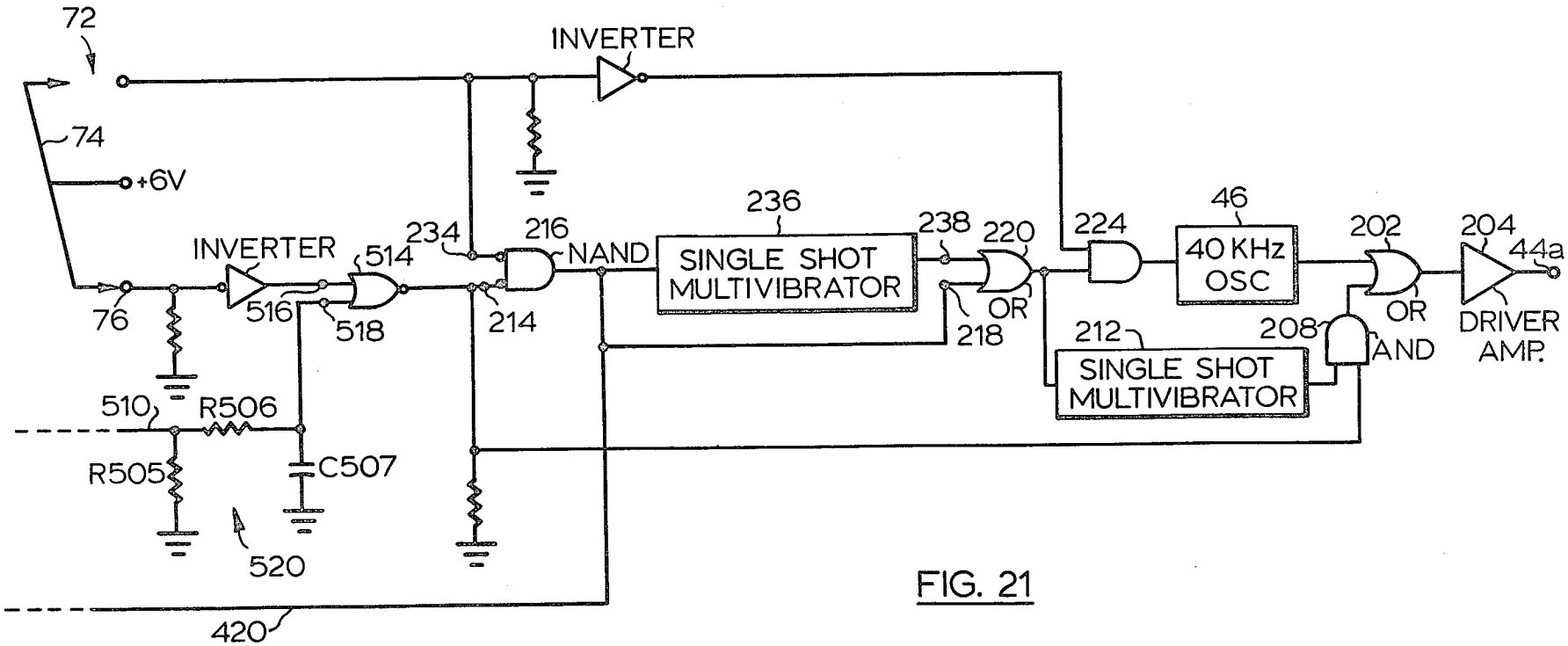
FIG. 21 is a schematic of a logic circuit of a master control unit, with an annunciatior control added.

Reference is next made to FIG. 21, which shows the master logic circuit of FIG. 10 but with certain additions to the input end of the circuit. Specifically, an inverter 512 and a NOR gate 514 having an input terminal 516 have been placed in series between terminal 75 of the rocker switch and input 214 of NAND gate 216. The other input 518 of NOR gate 514 is connected through an RC filter 520 (consisting of resistors R505 and R506 and capacitor C507) to conductor 510 (FIG. 18), i.e. to the clock terminal 504-1. As before, the output of NAND gate 216 is connected to conductor 420.

In operation, in supervisory condition, with the key switch 508 of the remote annunciator in its open position, clock line 502-1 and hence conductor 510 is low. Therefore a low is applied to input 518 of NOR gate 514 (FIG. 21). In addition, since the rocker switch 72 is in its normal supervisory position drawn, the other input 516 of NOR gate 514 is also low, producing a high at input 214 of negative logic NAND gate 216 as previously described for the supervisory condition of the master control logic.

When the key switch 508 is closed, clock line 502-1 goes high, producing a high at input 518 of NOR gate 514. This produces a low at the output of NOR gate 514, producing a high at the output of NAND gate 216 as previously described. This high, coupled with the high from the output of inverter 228, produces a high at the output of AND gate 224 to inhibit oscillator 46 as previously described. In addition, the high at the output of NAND gate 216, applied via conductor 420, initiates operation of oscillator 430. As the annunciation proceeds, and low clock pulses are transmitted via transistor Q6 (FIG. 18) to clock terminal 504-1, the low clock pulses are prevented by RC filter 520 from reaching input 518 of NOR gate 514.

After the annunciation has been completed and the investigator opens key switch 508, clock line 502-1 goes low. This resets register 454' and flip-flop 450' as previously indicated, and also removes the high from input 518 of NOR gate 514, restoring the master logic circuit to its previously supervisory condition. It is not necessary for the master logic circuit to be placed in its walk test condition, since whenever the condition of the master logic circuit is changed from alarm investigate (system status) to supervisory, the output of OR gate 220 goes from high to low, triggering the single shot 212 and producing a 0.4 second high (a reset signal) to reset the satellites to supervisory condition as indicated in section G (iii) of the foregoing description.

The remote annunciator 500 also includes a tamper switch 522 which is normally open and which is connected between +6 volts and the alarm terminal 506-2. If the remote annunciator is tampered with, the tamper switch 522 will close, pulling the alarm line 506-2 high and operating the tamper switch signal generator 330 (FIG. 18) in the master control unit.

N - Test Transceiver - Separate Cable

In the system described, if a transmitter or receiver component in a satellite should fail, this would not be detected at the master control circuit. An intrusion could then occur without detection.

Figure 22:
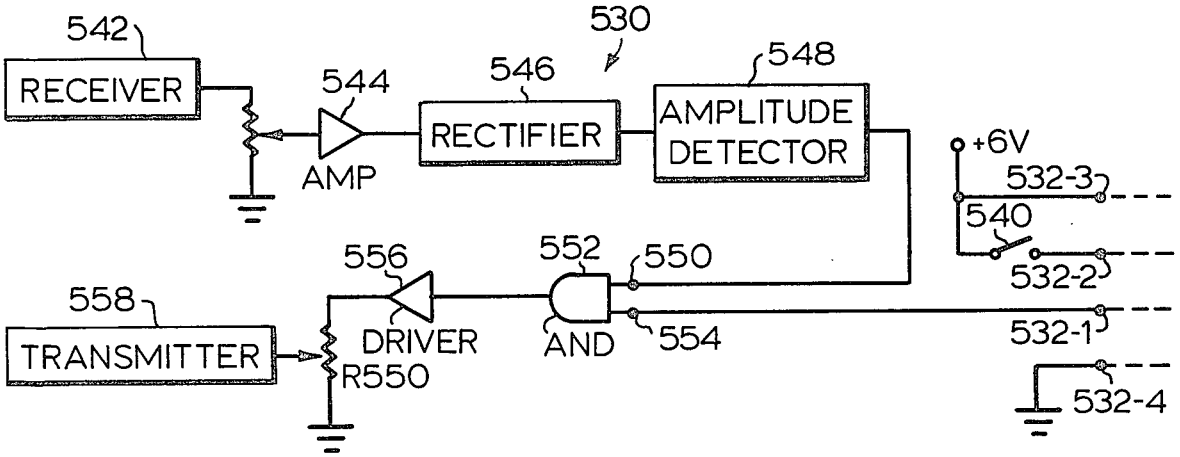
FIG. 22 is a block diagram showing a test tranceiver for use with the invention and connected on a separate cable.

FIG. 22 therefore illustrates a test transceiver 530 which may be used for periodic testing of the satellite. The test transceiver 530 is a separate unit, physically separated from the satellite and separately connected to the master control unit by terminals 532-1 to 532-4 which are connected by a four wire cable 534 to the master. Terminal 532-1 is connected to a source 536 (FIG. 18) of 40,050 Hz drive which is diagrammatically illustrated as being operated by switch 538. Terminal 532-2 is connected to the alarm terminal 44*b* of the master. Terminals 532-3 and 532-4 supply power to the test transceiver. A normally open tamper switch 540 closes if the test transceiver is tampered with to drive the alarm terminal 44*b* of the master high.

The test transceiver 530 includes a receiver 542 of the same kind as the receivers used in the satellites. The signal transmitted from the transmitter of the satellite is received by receiver 542, amplified in amplifier 544, full wave rectified in rectifier 546, and them amplitude detected by amplitude detector 548. The amplitude detector 548 is of the kind which produces an output only when its input exceeds a preset adjustable average level. When amplitude detector 548 produces an output, this enables input 550 of NAND gate 552.

The second input 554 of NAND gate 552 is connected to terminal 532-1 and hence to the source 536 of 40,050 Hz drive.

When it is desired to test the satellites, first an annunciation cycle is performed by moving the rocker switch 72 to its intermediate position, or by operating the key switch 508, to interrogate the satellites. At this time, assuming that there has been no intrusion into the areas protected by the system, no alarms should be recovered. Then the system is returned to its normal supervisory condition and switch 538 (FIG. 18) is closed for a brief interval. This applies 40,050 Hz drive to input 554 of AND gate 552. Since input 550 of AND gate 552 is high (if the satellite transmitter is functioning properly), the drive is applied through AND gate 552 to a driver amplifier 556 and hence through an adjustable resistor R550 to transmitter 558. Transmitter 558 then transmits a signal at 40,050 Hz, which simulates an alarm condition for the satellite and should cause an alarm signal to be generated by the satellite. An annunciation cycle is therefore next executed, and all of the satellites should indicated alarm conditions. If a satellite does not indicate an alarm condition, this is an indication that the satellite is malfunctioning.

O - Test Transceiver - System Cable

Figure 23:
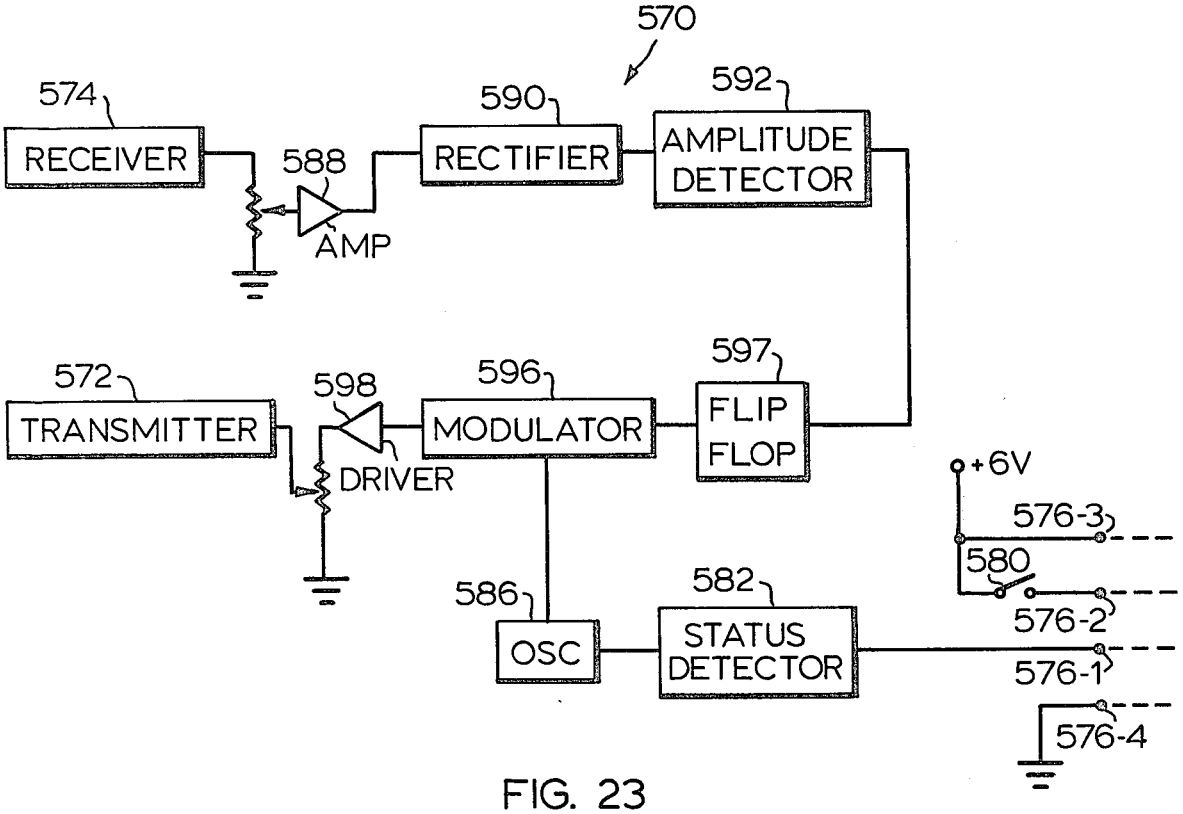
FIG. 23 is a block diagram showing a test tranceiver for use with the invention and connected to the system cable.

If it is desired to provide a test transceiver on the system cable, i.e. on a cable connected to the satellite rather than on a separate cable connected to the master control unit, then the system shown in FIG. 23 may be used. The test system shown in FIG. 23, and indicated generally at 570, includes a test transmitter 572 and a test receiver 574. The system includes four terminals 576-1 to 576-4, connected by a four wire cable 578 to the satellite terminals 40*a* to 40*d* respectively. Terminal 576-1 is connected to the satellite terminal 40*a* and is a drive terminal; terminal 576-2 is connected to satellite terminal 40*b* and is the alarm terminal (for a normally open tamper switch 580), and terminals 576-3 and 576-4 are connected to the power terminals of the satellite.

Since the test transceiver 570 is connected to the satellite, and since it is undesirable to provide a separate accurate oscillator in test transceiver 570, the test transceiver must therefore operate from the 40 KHz provided by the master control unit. For this purpose, a status detector 582 is provided, connected to the test transceiver drive terminal 576-1. The status detector 582 contains a duplicate of the satellite input circuit, i.e. it contains (see FIG. 13) trigger 50, diode D1 and capacitor C1, trigger 100, inverter 102, latch 110, diode D2 and resistor R5, capacitor C4, and trigger 132, all connected as in the satellite. It will be recalled that in the satellite, when the drive signal was turned off (section D of the foregoing description), latch 110 was set. Similarly, the corresponding latch in status detector 582 is then set, and the output of this latch, taken at output terminal 584, then enables a low frequency oscillator 586 which provides a frequency of between 50 and 100 Hz. It will also be recalled that in the satellite, when the drive signal was turned on again for walk testing (section E of the foregoing description), latch 110 remained set and similarly oscillator 586 therefore remains enabled.

Therefore, to test the satellites, the master control unit is operated to place the system in its alarm investigate or system status mode (section D of the description) and an annunciation cycle is completed. Then the system is placed in its walk test mode (section E of the description), i.e. the drive signal is reapplied to the satellites. The receiver 574 then receives the field transmitted by the satellite transmitter, and the signal from receiver 574 is amplified by amplifier 588, full wave rectified by rectifier 590, and amplitude detected by amplitude detector 592. Only the portion of the rectified wave form which exceeds a pre-set threshold emerges from the amplitude detector 592. The output of detector 592 is therefore a series of sinusoidal pulses, of 80 KHz frequency but of width depending on the amplitude of the pulses. This output is fed to a flip-flop 594 which divides the input frequency in half and produces a clean square wave output at 40 KHz which is fed to phase modulator 596. The signal fed to modulator 596 is modulated by oscillator 586, and the resultant modulated signal is applied to a driver 598 which drives transmitter 572.

The result is that if the satellite transmitter is transmitting at an adequate level, drive signal is applied to test transmitter 572 at a frequency such as to cause the satellite signal processing circuit to produce an alarm. The system is then returned to its system status or annunciate condition so that the presence of the alarms can be checked.

Since it is undesirable to have transmitter 572 transmitting except when status detector 582 has operated, modulator 596 is of a kind which will not transmit the carrier signal from flip-flop 594 except when the modulator receives a signal from oscillator 806. In effect the modulator functions like an AND gate. Alternatively an AND gate can be placed in series bertween flip-flop 594 and modulator 596 and the second input of the AND gate can be supplied from status detector 582, to ensure that no transmission from transmitter 572 will occur except when desired.

It will be appreciated that a test program device can be provided to automatically initiate satellite testing every few minutes, to ensure that the satellites are in working order at all times. Means may be provided to determine automatically whether all of the satellites have produced the required alarms after a test, and to generate a satellite-out-of-order signal if a satellite has not produced the requisite alarm.

It will also be appreciated, as indicated, that the annunciation and test systems of the inventor may be used with satellites which use contacts (for example door and window switches) instead of transmitters and receivers as their intrusion detector elements, and with transmitter and receiver systems such as infra-red systems. In these cases a "drive" signal as such may not be used, but a control signal will normally be sent from the master drive signal terminal to the satellite drive signal terminals (which now are control signal terminals) to turn the transmitter on and off, or to turn the power on and off to the contact switches (since it would be undesirable for example to have alarms generated during annunciation or during testing).

What I claim as my invention is:

1. An intrusion alarm system comprising:

(1) a master control unit having:

(a) two master power supply terminals, and power supply means coupled thereto for supplying power to said master power supply terminals, (b) a master drive signal terminal, and a drive signal generator coupled thereto for applying a drive signal to said master drive signal terminal, (c) a master alarm signal terminal, and a detector coupled thereto and responsive to receipt of a predetermined high level first alarm signal thereat for generating a second alarm signal, (2) a plurality of satellite units, each having:

(a) a satellite drive signal terminal, and a transmitter coupled thereto and responsive to receipt of said drive signal thereat for transmitting a radiation field in a supervised area, (b) a receiver for receiving a portion of said radiation field which is reflected from objects in said area, (c) signal processing means coupled to said receiver for comparing the transmitted and received fields and responsive to disturbances in said received field caused by a moving intruder in the supervised area, for generating a third alarm signal upon occurrence of such disturbance, (d) a satellite alarm signal terminal, (e) a control circuit coupled to said signal processing means and to said satellite alarm signal terminal and responsive to receipt of said third alarm signal for generating said high level first alarm signal at said satellite alarm signal terminal, (f) enable means responsive to receipt of said third alarm signal and operative for thereupon producing an enable signal, (g) two satellite power receiving terminals for receiving power and coupled to said transmitter, said receiver, said signal processing means, and said control circuit for supplying power thereto, (3) a cable having only four wires connecting each satellite unit to said master control unit, two of said wires being connected between said master power supply terminals and said satellite power receiving terminals, a third of said wires being connected between said master drive signal terminal and said satellite drive signal terminal, and the fourth of said wires being connected to said master alarm signal terminal and said satellite alarm signal terminal, (4) each satellite further having:

(h) satellite counter means, and means connected between said satellite counter means and said control circuit for enabling said satellite counter means upon production of said enable signal and subsequent termination of application of said drive signal to said satellite drive signal terminal, (i) said satellite counter means including means connected with said satellite drive signal terminal and responsive, when said counter means has been enabled, to receipt of a high level counting signal at said satellite drive signal terminal for causing said satellite counter means to count, (j) said satellite counter means having an output corresponding to a selected count of said counter means said selected count being different from that of each counter means of each other satellite, (k) said satellite counter means further including means connected to said satellite alarm signal terminal for generating, if said counter means has been enabled, a short duration high level fourth alarm signal at said selected count of said satellite counter means, the duration of said high level fourth alarm signal being not greater than the duration of a count of said satellite counter means, (5) each master control unit further having:

(d) master counter means coupled to said master drive signal terminal for generating said high level counting signal at said master drive signal terminal, said high level counting signal having a count for each satellite, (e) control means coupled to said master drive signal terminal and to said master counter means and selectively operable to discontinue application of said drive signal to said master drive signal terminal and to then initiate operation of said master counter means for application of said high level counting signal to said master drive signal terminal, (f) said control means including means for terminating operation of said master counter means after said master counting means has generated a selected number of counts, said selected number being at least equal to the total number of said satellites, (6) and satellite status indicating means comprising:

(a) register means having a plurality of indicating outputs, one corresponding to each satellite;

(b) said register means including means connected to said alarm signal terminal and to said master counter means and responsive to receipt of said fourth high level alarm signal during a selected number of said master counter means for generating an indicating signal at the indicating output corresponding to the satellite associated with said selected count, (c) and indicating means connected to said register means and responsive to said indicating signals for indicating the status of said satellites, whereby an investigator inspecting said register means may determine which if said satellites has or has not generated a said high level first alarm signal.

2. A system according to claim 1 wherein said satellite status indicating means is located in said master control unit.

3. A system according to claim 1 wherein said satellite status indicating means is located remote from said master control unit and is connected to said master control unit by only four wires, two of said wires being connected to said master power supply terminals, a third of said wires being connected to said master alarm signal terminal, and the fourth of said wires being connected to said master drive signal terminal.

4. A system according to claim 3 wherein said satellite status indicating means includes switch means connected between the wires connected to said master drive signal terminal and said master alarm signal terminal and operative for producing a high level switch signal, and said control means of said master control unit includes means responsive to said switch signal for discontinuing application of said drive signal to said master drive signal terminal and for then initiating operation of said master counter means.

5. A system according to claim 1, 2, or 3 wherein said master counter means includes a counter having a plurality of counter stages and wherein said register means comprises a shift register having a clock input, a reset input, and a signal input, means connecting one of said counter stages to said clock input for the output from said one counter stage to clock said shift. register, means connecting a second of said counter stages to said master drive signal terminal to provide said high level counting signal, said second stage being subsequent to said first stage, means connected to said register signal input and to said one counter stage for entering an overflow signal in said register at the first count of said master counter means, said register hving a plurality of indicating stages, one for each indicating output, and having an overflow stage subsequent to said indicating stages, and control means connected between said overflow stage and said counter for terminating operation of said counter and also connected to said indicating means for initiating operation of said indicating means.

6. A system according to claim 1, 2 or 3 including a test transceiver connected to said master control unit and located in a said supervised area, said test transceiver being physically separate from the satellite in such supervised area and including a test receiver for receiving said radiation field, a transmitter for transmitting a test radiation field, AND gate means having two inputs and an output, means connected between said test receiver and one of the inputs of said AND gate means for applying an enabling signal to said one input of said AND gate means if the signal received by said test receiver is above a selected level, means for applying a test drive signal having a test frequency to said second input of said AND gate means, and means connected between the output of said AND gate means and said test transmitter and responsive to receipt of an output from said AND gate means at said test frequency for operating said test transmitter at said test frequency upon the presence of both said test signal and said enabling signal at said inputs of said AND gate means, so that when said test drive signal is applied, said test transmitter will operate if said receiver has received sufficient signal, said test frequency being such as to simulate a disturbance caused by a moving intruder in the supervised area, said test transceiver being connected to said master control unit by not more than four wires, two of said wires being power supply wires and one of said wires being for transmission of said test drive signal.

7. A system according to claim 1, 2 or 3 and including a test transceiver connected to a satellite and located physically separate from said satellite but in said supervised area of said satellite;

said test transceiver being connected to said satellite by not more than four wires; two of said wires being power supply wires and one of said wires being connected to said satellite drive signal terminal;

said test transceiver including: a test receiver for receiving said radiation field; a transmitter for transmitting a test radiation field; modulating means having a carrier signal input, a modulating signal input and an output; means connected between said test receiver and said carrier signal input and responsive to receipt from test receiver of a received signal above a selected level for generating from said received signal and applying to said carrier signal input a said carrier signal; status detector means connected to said wire connected to said satellite drive signal terminal having a first normal state and operative to a second state upon the termination and subsequent restoration of said drive signal thereat and including means responsive to a predetermined signal at said satellite drive signal terminal for resuming said first state, local oscillator means connected to said modulating signal input and to said status detector means and responsive to the status of said status detector means for generating and applying a modulating signal to said modulating signal input when said satuts detector means is in said second state, for said modulating means thereby to generate at its output a modulated carrier signal, and means connected between said output of said modulating means and said test transmitter for operating said test transmitter from said modulated carrier signal, the frequency of said modulated carrier signal being such as to simulate the disturbance caused by a moving intruder in the supervised area.

8. A system according to claim 1, 2 or 3 wherein said master control unit includes tamper alarm detector means coupled to said signal terminal and responsive to receipt thereat of a high level fifth alarm signal different from said high level first alarm signal from generating a tamper alarm; and each satellite includes a housing, a cover removable from said housing for providing access to said housing, and a tamper switch within said housing and operable upon removal of said cover, said control circuit including tamper switch detector means connected to said tamper switch and to said satellite alarm signal terminal and responsive to operation of said tamper switch for generating said high level fifth alarm signal at said satellite alarm signal terminal, said control circuit further including means connected between said tamper switch and said enable means for operating said enable means upon operation of said tamper switch, so that when said high level counting signal is applied to said master drive signal terminal, each satellite the enable means of which have operated will generate a said short duration high level fourth alarm signal at the associated count of said master counter means, whereby the operation of said tamper switches of said satellites may be annunciated.

9. An intrusion alarm system comprising:

(1) a master control unit having:

(a) two master power supply terminals, and power supply means coupled thereto for supplying power to said master power supply terminals, (b) a master control signal terminal and a control means coupled thereto for applying a control signal to said master control signal terminal, (c) a master alarm signal terminal, and a detector coupled thereto and responsive to receipt of a predetermined high level first alarm signal thereat for generating a second alarm signal, (2) a plurality of satellite units, each having:

(a) a satellite control signal terminal, (b) intrusion detection means having a supervisory state and a non-supervisory state, said intrusion detection means including means operable when said intrusion detection means is in said supervisory state for detecting an intrusion in a supervised area and for generating a third alarm signal upon occurrence of such intrusion, said intrusion detection means including means coupled to said satellite control signal terminal and responsive to receipt of a control signal thereat for causing said intrusion detection means to assume said supervisory state, (c) a satellite alarm signal terminal, (d) a control circuit coupled to said intrusion detection means and to said satellite alarm signal terminal and responsive to receipt of said third alarm signal for generating said high level first alarm signal at said satellite alarm signal terminal, (e) enable means responsive to receipt of said third alarm signal and operative for thereupon producing an enable signal, (f) two satellite power receiving terminals for receiving power and coupled to said transmitter, said receiver, said signal processing means, and said control circuit for supplying power thereto, (3) a cable having only four wires connecting each satellite unit to said master control unit, two of said wires being connected between said master power supply terminals and said satellite power receiving terminals, a third of said wires being connected between said master control signal terminal and said satellite control signal terminal, and the fourth of said wires being connected to said master alarm signal terminal and said satellite alarm signal terminal, (4) each satellite further having:

(g) satellite counter means, and means connected between said satellite counter means and said control circuit for enabling said satellite counter means upon production of said enable signal and subsequent termination of application of said control signal to said satellite drive signal terminal, (h) said satellite counter means including means connected with said satellite control signal terminal and responsive, when said counter means has been enabled, to receipt of a high level counting signal at said satellite control signal terminal for causing said satellite counter means to count, (i) said satellite counter means having an output corresponding to a selected count of said counter means, said selected count being different from that of each counter means of each other satellite, (j) said satellite counter means further including means connected to said satellite alarm signal terminal for generating, if said counter means has been enabled, a short duration high level fourth alarm signal at said selected count of said satellite counter means, the duration of said high level fourth signal being not greater than the duration of a count of said satellite counter means, (5) each master control unit further having:

(d) master counter means coupled to said master control signal terminal for generating said high level counting signal at said master control signal terminal, said high level counting signal having a count for each satellite, (e) control means coupled to said master control signal terminal and to said master counter means and selectively operable to discontinue application of said control signal to said master control signal terminal and to then inititiate operation of said master counter means for application of said high level counting signal to said master control signal terminal, (f) said control means including means for terminating operation of said master counter means after said master counting means has generated a selected number of counts, said selected number being at least equal to the total number of said satellites, (6) and satellite status indicating means comprising:

(a) register means having a plurality of indicating outputs, one corresponding to each satellite, (b) said register means including means connected to said alarm signal terminal and to said master counter means and responsive to receipt of said high level fourth alarm signal during a selected number of said master counter means for generating an indicating signal at the indicating output corresponding to the satellite associated with said selected count, (c) and indicating means connected to said register means and responsive to said indicating signals for indicating the status of said satellites, whereby an investigator inspecting said register means may determine which of said satellites has or has not generated a said high level first alarm signal.

10. A system according to claim 9 wherein said intrusion detector means includes transmitter means coupled to said satellite control signal terminal and responsive to receipt of said control signal thereat for transmitting radiation in said supervised area, receiving means for receiving at least a portion of said radiation, and signal processing means coupled to said receiving means and responsive to disturbances in the received radiation caused by a moving intruder in the supervised area, for generating said third alarm signal upon occurrence of such disturbance.

11. A system according to claim 9 or 10 wherein said master control unit includes tamper alarm detector means coupled to said master alarm signal terminal and responsive to receipt thereat of a high level fifth alarm signal different from said high level first alarm signal for generating a tamper alarm; and each satellite includes a housing, a cover removable from said housing for providing access to said housing, and a tamper switch within said housing and operable upon removal of said cover, said control circuit including tamper switch detector means connected to said tamper switch and to said satellite alarm signal terminal and responsive to operation of said tamper switch for generating said high level fifth alarm signal at said satellite alarm signal terminal, said control circuit further including means connected between said tamper switch and said enable means for operating said enable means upon operation of said tamper switch, so that when said high level counting signal is applied to said master control signal terminal, each satellite the enable means of which have operated will generate a said short duration high level fourth alarm signal at the associated count of said master counter means, whereby the operation of said tamper switches of said satellites may be annunciated.

* * * * *